US005126789A

United States Patent [19]

Fukuchi et al.

[11] Patent Number: 5,126,789

[45] Date of Patent: Jun. 30, 1992

[54] IMAGE FORMING APPARATUS

[75] Inventors: Masakazu Fukuchi; Shizuo Morita; Satoshi Haneda; Hisao Satoh; Tadayoshi Ikeda, all of Hachioji, Japan

[73] Assignee: Konica Corporatoin, Tokyo, Japan

[21] Appl. No.: 735,359

[22] Filed: Jul. 24, 1991

[30] Foreign Application Priority Data

Jul. 26, 1990 [JP] Japan ..... 2-200782
Jul. 26, 1990 [JP] Japan ..... 2-200784
Jul. 26, 1990 [JP] Japan ..... 2-200785
Jul. 26, 1990 [JP] Japan ..... 2-200798

[51] Int. Cl.[5] ..... G03G 21/00

[52] U.S. Cl. ..... 355/200; 355/208; 355/210; 355/308; 271/162

[58] Field of Search ..... 355/203, 204, 208, 210, 355/316, 321, 308, 211, 200, 309; 271/162, 164

[56] References Cited

U.S. PATENT DOCUMENTS 4,306,802 12/1981 Kucera et al. ..... 355/309
4,609,281 9/1986 Miyai et al. ..... 355/210
4,751,552 6/1988 Itoigawa ..... 355/200
4,791,454 12/1988 Takahashi et al. ..... 355/260 X
4,951,090 8/1990 Matsumoto et al. ..... 355/200
5,041,872 8/1991 Nukaya et al. ..... 355/200
5,044,620 9/1991 Ruch et al. ..... 271/162 X
5,065,195 11/1991 Haneda et al. ..... 355/210 X

FOREIGN PATENT DOCUMENTS 0182626 1/1990 Japan ..... 271/162
0230165 9/1990 Japan .
0013428 1/1991 Japan ..... 271/162

*Primary Examiner*—A. T. Grimsley
*Assistant Examiner*—Matthew S. Smith
*Attorney, Agent, or Firm*—Frishauf, Holtz, Goodman & Woodward

[57] ABSTRACT

An image forming apparatus having a cassette for containing copy sheets, the cassette being releasable responsive to the opening of an upper cover to cover an upper portion of the apparatus. The image forming apparatus may be further provided with a cartridge for carrying at least one of an image carrying body, developing units and a cleaning unit, and the cartridge is also released responsive to the opening of the upper cover of the image forming apparatus.

14 Claims, 30 Drawing Sheets (DRIVING MEANS)
PROCESS CARTRIDGE DRIVING MEANS
CASSETTE DRIVING MEANS
C22
M2
C23
CONTROLLER
PROCESS SEQUENCE MEMORY
(SIGNALS)
COPY
PULL OUT
SET
EMPTY CASSETE
JAM
PROCESS CARTRIDGE POSITION
CASSETTE POSITION
UPPER COVER POSITION
DRIVE PHOTORECEPTOR
FIX & PAPER DISCHARGE
PAPER FEED
(PUSH BUTTONS)
START COPY
PULL OUT
SET
S0
S1
S2
S3
S4
JUDGE JAM
MS1
MS2
MS3
MS4
MS5
MS6
COPY PROCESS

FIG. 15

| JAM POSITION | PROCESS CARTRIDGE DRIVING MEANS | CASSETTE DRIVING MEANS |
|---|---|---|
| $S_0$ EMPTY CASSETTE | | ○ |
| $S_1$ PAPER FEED | | ○ |
| $S_2$ TIMING | ○ | ○ |
| $S_3$ TRANSFER | ○ | |
| $S_4$ PAPER DISCHARGE | | |

FIG. 18

| JAM POSITION | PROCESS CARTRIDGE DRIVING MEANS | CASSETTE DRIVING MEANS | UPPER COVER OPENING MEANS |
|---|---|---|---|
| $S_0$ EMPTY CASSETTE | | ○ | |
| $S_1$ PAPER FEED | | ○ | |
| $S_2$ TIMING | ○ | ○ | ○ |
| $S_3$ TRANSFER | ○ | | ○ |
| $S_4$ PAPER DISCHARGE | | | ○ |

IMAGE FORMING APPARATUS

BACKGROUND OF THE INVENTION

The present invention relates to an image forming apparatus in which an image can be obtained in such a manner that: a toner image is formed on an image carrier by means of electrophotography; and the formed toner image is transferred onto a transfer sheet. The present invention more particularly relates to an image forming apparatus such as a printer, copier and facsimile in which a process cartridge is detachably provided, wherein the image carrier and at least one of a developing means and cleaning means are integrally installed in the process cartridge.

As the size of an image forming apparatus such as a printer and copier has been made small, and its functions have been improved, the structure of the image forming apparatus has become highly precise and complicated.

When the conveyance of a transfer sheet is blocked in its conveyance passage, what is called a jam occurs, and the jammed transfer sheet (which will be referred to as a jammed paper, hereinafter) must be removed from the apparatus. In order to remove the jammed paper, a working space into which an operator can reach, must be made in the apparatus in such a manner that: an external door of the image forming apparatus can be opened; and a portion of a transfer sheet passage or all of the transfer paper passage is moved if necessary. Since the aforementioned work to remove the jammed paper is conducted by an operator who is an untrained user, the structure of the apparatus must be made simple so that the work can be conducted without expertise.

Recently, an image forming apparatus having a process cartridge in which an image carrier and at least one of a developing means and a cleaning means are integrated into one unit, has been developed so that an operator can maintain the apparatus easily.

In the case of an image forming apparatus such as a printer and a copier having a process cartridge, when an image carrier provided in the process cartridge is consumed or deteriorated, the process cartridge itself is replaced with a new one, so that an operator can maintain the image forming apparatus without any expertise. In the apparatus described above, the apparatus is provided with a guide member by which the process cartridge can be guided, and all the operator must do is to insert the process cartridge into the apparatus along the guide member.

In a conventional image forming apparatus, the direction of process cartridge removal and that of transfer sheet movement make a right angle with each other, so that the work of process cartridge removal is troublesome and complicated, and further the space to install the image forming apparatus is restricted. Furthermore, a wide space is required to maintain the apparatus.

In order to solve the aforementioned conventional problems, an image forming apparatus disclosed in the official gazette of the Japanese Patent Publication Open to Public Inspection No. 279870/1986 has been proposed. In the apparatus disclosed in the aforementioned official gazette, the direction of the transfer sheet movement agrees with the direction of process cartridge removal, so that the parts can be easily replaced and the operation can be conducted easily, and further, the working space is not restricted. However, in the case of the image forming apparatus disclosed in the official gazette of the Japanese Patent Publication Open to Public Inspection No. 279870/1986, the process cartridge is replaced in such a manner that: the upper housing of the apparatus is opened, and the operator must pull the process cartridge from the apparatus and then take it out. Therefore, the work is very hard for the operator when the process cartridge is large and heavy.

In the case where a paper jam has occurred in the conveyance passage, the operator must put his hands into a small space in the apparatus in order to remove the jammed paper. Even when the upper housing has been opened, it is difficult for the operator to ensure a sufficiently wide working space, so that it is hard to remove the jammed paper from the transfer sheet conveyance passage. In order to ensure a sufficiently wide working space, the operator must pull the process cartridge out of the upper housing, which is complicated and troublesome. As described above, the aforementioned apparatus has the defect that jam treatment is difficult.

SUMMARY OF THE INVENTION

The present invention has been achieved in order to solve the aforementioned problems. It is a primary object of the present invention to provide an image forming apparatus characterized in that: the process cartridge can be easily moved or replaced; and maintainability is high.

Another object of the present invention is to provide an image forming apparatus characterized in that: a jammed paper in a paper conveyance passage can be easily removed; and maintenance of the apparatus can be easily and safely performed.

Further, another object of the present invention is to provide an image forming apparatus characterized in that: even when a process cartridge or paper feed cartridge is not set to a correct position, the incorrect positioning can be visually checked easily so that the image forming process can be positively performed.

The aforementioned object can be accomplished by an image forming apparatus, comprising: a detachable process cartridge integrally provided with an image carrier on which an electrostatic latent image is formed, and provided with at least one of a developing means and a cleaning means; a process cartridge moving means which moves the aforementioned process cartridge from the image forming position; a detachable cassette in which transfer sheets are housed; a cassette moving means which moves the aforementioned cassette from the paper feeding position; a jam detection means which detects a jam of a transfer sheet caused in a conveyance passage, and outputs a jam signal; and a control means which outputs a control signal to the process cartridge moving means and the cassette moving means according to the jam signal.

The aforementioned object can be accomplished by an image forming apparatus, comprising: a transfer sheet cassette which is detachably provided; a cassette moving means which moves the cassette from the paper feeding position; a detecting means which detects release of an upper cover of the apparatus and outputs a release signal; and a control means which outputs a control signal to the cassette moving means according to the detected release signal.

The aforementioned object can be accomplished by an image forming apparatus, comprising: a detachable process cartridge integrally provided with an image carrier on which an electrostatic latent image is formed, and provided with at least one of a developing means and a cleaning means; a process cartridge moving means which moves the aforementioned process cartridge form the image forming position; a detachable cassette in which transfer sheets are housed; a cassette moving means which moves the aforementioned cassette from the paper feeding position; a plurality of jam detection means which detect a jam and a jamming position of a transfer sheet at a plurality of positions on a transfer paper conveyance passage, and outputs a jam signal; and a control means which outputs a control signal to the process cartridge moving means and/or the cassette moving means according to the jam signal. The aforementioned object can be accomplished by an image forming apparatus in which a process cartridge integrally provided with an image forming means including an image carrier having an electrostatic image, and a paper feed cassette having transfer sheets, are detachably provided to an apparatus body, and which comprises: an upper lid which can open a portion of the housing above the aforementioned process cartridge of the aforementioned image forming apparatus, wherein the aforementioned process cartridge and paper feeding cassette can be detached from a normal setting position according to a detection signal generated when the aforementioned upper lid member is opened.

The image forming apparatus of the present invention is composed in such a manner that: in the case where a paper jam has occurred in a paper discharging passage when a transfer paper is discharged by a paper discharging means after being sent out from the aforementioned paper feeding cassette and transfer means, the aforementioned upper lid is opened according to the jam detection signal.

Further, the aforementioned image forming apparatus is characterized in that: the upper surface of the aforementioned upper lid is formed so as to receive a stack of discharged transfer sheets thereon.

Further, the aforementioned image forming apparatus is characterized in that: the aforementioned upper lid can be opened by an electrically driven unit.

Further, the aforementioned image forming apparatus is characterized in that: the aforementioned upper lid can be manually opened and a portion of the inside of the apparatus body close to the inside of the upper lid is exposed.

Further, the aforementioned image forming apparatus is characterized in that: the image carrier of the aforementioned process cartridge is a photoreceptor belt.

DESCRIPTION OF THE DRAWING

FIG. 15 is a view showing the control of the process cartridge moving means and the cassette moving means, wherein the control is conducted in accordance with a position in which a jam has occurred;

FIG. 18 is a view showing the control of the process cartridge moving means and the cassette moving means in another embodiment, wherein the control is conducted in accordance with a position in which a jam has occurred;

FIG. 19 is a left side sectional view of the essential portion of a color printer to which the image forming apparatus of the present invention is applied;

FIG. 20 is a perspective view of the aforementioned image forming apparatus;

FIG. 21 is a left side view of the drive system of the image forming apparatus of the present invention;

FIG. 22 is plan view of the essential portion of the drive system of the process cartridge and the developing unit;

FIG. 23 is a view showing the essential portion of the drive system of the process cartridge;

FIG. 24 is a schematic illustration showing a model of the process of movement of the process cartridge;

FIGS. 25-*a*, 25-*b* are side sectional views showing the opening mechanism and the opened state of the upper cover;

FIGS. 26-*a*, 26-*b* are a partial plan view and a side sectional view showing another opening mechanism of the upper cover;

FIG. 27 is a block diagram showing the control system;

FIG. 28 is a perspective view of the image forming apparatus, the upper cover and the front cover of which are opened;

FIG. 29 is a side sectional view of the upper unit;

FIG. 30 is a side sectional view of a transfer drum type of image forming apparatus to which the present invention is applied; and FIG. 31 is a side sectional view of the image forming apparatus of the present invention to which an image reading-out unit is provided.

DETAILED DESCRIPTION OF THE INVENTION

Referring to an embodiment illustrated in the attached drawings, the present invention will be explained as follows.

Figure 1:
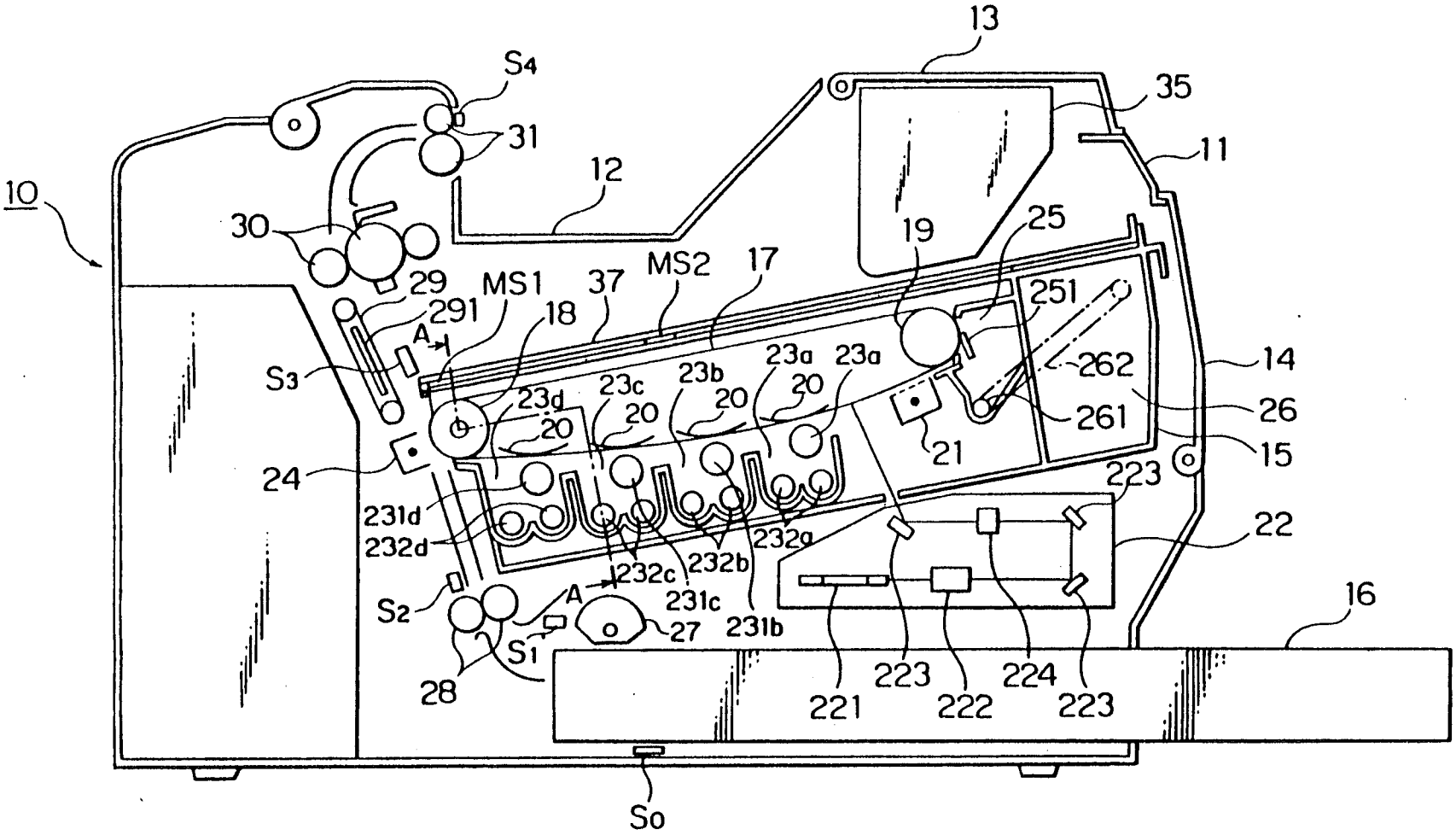
FIG. 1 is a sectional view showing the left side of a color printer to which the present invention is applied.

FIG. 1 is a left side sectional view of the essential portion of a color printer to which the present invention is applied. The apparatus body 10 exterior has: an operation panel 11 which is provided in the front portion of the apparatus 10; an upper cover 12 which can be opened and closed; a toner supply cover 13; and a front cover 14. Inside the apparatus are provided a detachable process cartridge 15 and paper feed cassette 16.

In FIG. 1, a photoreceptor belt 17, which is an image carrier, is made in such a manner that a photosensitive material layer is coated on the surface of a flexible belt. The photoreceptor belt 17 is stretched around a drive roller 18 and an idle roller 19. The drive roller 18 is driven by a drive gear which meshes with a gear provided in the apparatus body 10, so that the photoreceptor belt 17 is rotated clockwise. (This drive mechanism will be explained later.) The distance between developing units 23*a*–23*d* and the photoreceptor belt 17 is maintained constant by a spacer 20, so that an image of high quality can be stably maintained. In this embodiment, the photoreceptor belt 17 is used for the image carrier. However, it should be understood that the present invention is not limited to the photoreceptor belt, and a conventional image carrier having a photosensitive material layer such as a photoreceptor drum may be utilized.

A charging means 21, an exposure means 22, developing means 23*a*–23*d*, a transfer means 24, and a cleaning means 25 are provided around the photoreceptor drum 17.

The charging means is provided in order to uniformly charge the photosensitive layer on the surface of the photoreceptor belt 17 to a predetermined polarity. A conventional corona charger or a scorotron charger is used for the charger 21. The scorotron charger is preferably used in the case where an OPC photoreceptor is used.

A semiconductor laser writing-in system unit 22 is the exposure means, in which an electrostatic latent image is formed on the photoreceptor belt 17 when the surface of the photoreceptor belt 17 which has been charged by the charger 21, is exposed.

The developing means comprises a plurality of developing units 23*a*–23*d* in which developers of different colors, such as yellow, magenta, cyan and black, are provided. These developing units 23*a*–23*d* are provided with: developing sleeves 231*a*–231*d* which are set in such a manner that the distances between the developing sleeves 231*a*–231*d* and the photoreceptor belt 17 are maintained to be a predetermined value; and stirring screws 232*a*–232*d* which stir the toners. Therefore, an electrostatic latent image on the photoreceptor belt 17 can be developed into a visual toner image by means of a non-contact developing method. This non-contact developing method is different from a contact developing method, and advantageous in that: a toner image which has been previously formed on the photoreceptor belt 17, is not damaged; and the movement of the photoreceptor belt 17 is not blocked by the developing unit, so that a color image of high quality can be obtained. In this embodiment, 4 different colors are used. However, the present invention can be adopted not only to the case in which 4 colors are used but also to the case in which a single color, 2 colors or 3 colors are used. In this case, developing units, the number of which is the same as the number of toner colors, may be provided around the photoreceptor belt 17.

The transfer means is composed of the transfer unit 24 such as a corona charger, and transfers the toner image formed on the photoreceptor belt 17 onto a transfer sheet. Instead of the transfer unit 24, a conventional transfer member such as a transfer drum may be used.

The cleaning means 25 is provided with a cleaning blade 251, and while an image is being formed, the cleaning blade is maintained in a position separated from the surface of the photoreceptor belt 17. After the toner image has been transferred onto a transfer sheet, the cleaning blade 251 is contacted with the surface of the photoreceptor belt 17 with pressure, so that the photoreceptor belt 17 can be cleaned.

A recovery toner box 26 recovers the residual toner in such a manner that: the residual toner on the photoreceptor belt 17 is recovered by a used toner screw 261 through a recovery pipe 262.

In this embodiment, the photoreceptor belt 17, the charger 21, the developing units 23*a*–23*d*, the cleaning means 25, and the toner recovery box 26 are integrally provided into the process cartridge 15, so that all the units can be attached to and detached from the apparatus body 10 all at once. All of the aforementioned units are not necessarily integrated into the process cartridge 15. It is sufficient that at least the photoreceptor belt 17 and the developing units 23*a*–23*d*, or the photoreceptor belt 17 and the cleaning means 25 are integrated into one unit. Further, other units may be added to the aforementioned combination.

The process of image formation according to the aforementioned color image forming apparatus is as follows.

First, the process cartridge 15 is placed in the first position so that the apparatus is in the state of image formation. When an image signal of the first color which is outputted from an image reading unit provided separately from the apparatus body 10, is inputted into the aforementioned laser writing system unit 22, a laser beam is generated by a semiconductor laser (not illustrated in the drawing) provided in the laser writing system unit 22. The laser beam is rotationally scanned by a polygonal mirror 221 which is rotated by a motor (not illustrated in the drawing), and then the laser beam is directed onto the peripheral surface of the photoreceptor belt 17 previously charged to a predetermined charge by the charger 21, through an f$\theta$ lens 222, a cylindrical lens 224 and three mirrors 223, so that a bright line is formed on the peripheral surface of the photoreceptor belt 17.

On the other hand, concerning the auxiliary scanning direction, when a belt index (not shown in the drawing) corresponding to a specific position of the photoreceptor belt 17 is detected, or when a print command signal is inputted, the primary scanning line from which the modulation of a semiconductor laser is started according to the image signal, is determined on the basis of the detection signal or the command signal. Then, the scanning is conducted as follows. Concerning the primary scanning direction, the laser beam is detected by an index sensor (not shown in the drawing). On the basis of the detected signal, the modulation of the semiconductor laser is started according to the image signal of the first color, and the surface of the photoreceptor belt 17 is scanned by the modulated laser beam. Accordingly, a latent image corresponding to the first color is formed on the surface of the uniformly charged photoreceptor belt 17 by the primary scanning conducted by the laser beam and the auxiliary scanning conducted by conveyance of the photoreceptor belt 17. The latent image formed in the manner described above is developed by a developing unit 23*a* in which yellow toner is provided so that a yellow toner image can be formed on the surface of the photoreceptor belt 17. The photoreceptor belt 17, on the surface of which the yellow toner image is formed, passes under the cleaning blade 251 which is separated from the surface of the photoreceptor belt 17, and then image formation of the second color starts.

The latent image of the second color is formed as follows. The photoreceptor belt 17 on which the yellow toner image is formed, is charged by the charging unit 21 again, and then the image signal of the second color is inputted into the aforementioned laser writing system unit 22 so that writing can be conducted on the surface of the photoreceptor belt 17 according to the image signal in the same manner as the first color. The formed latent image is developed by the developing unit 23*b* in which magenta toner is provided, wherein magenta is the second color. The magenta toner image is formed under the presence of the yellow toner image which has been already formed.

In the same manner described above, a latent image formed by the image signal of the third color is developed by the developing unit 23*c* in which cyan toner is provided so that a cyan toner image can be formed. Further, a latent image formed according to the image signal of the fourth color is developed by the developing unit 23*d* in which black toner is provided so that a black toner image can be formed on the surface of the photoreceptor belt 17. A color toner image is formed on the surface of the photoreceptor belt 17 by superimposing the toner images in the aforementioned manner.

A bias of DC or AC is impressed upon the developing sleeves 231*a*–231*d* of the developing units 23*a*–23*d* so that reversal development (jumping development) can be conducted on the photoreceptor belt 17 connected to earth, under the condition of non-contact. Either a one-component developer or a two-component developer can be used for non-contact development. When a one-component developer is used, it is not necessary to install a toner hopper independently, so that the size of the apparatus can be reduced. However, from the viewpoint of stability of development, the two-component developer is superior to the one-component developer, and preferably used.

The color toner image formed on the surface of the photoreceptor belt 17 in the aforementioned manner, is transferred onto a transfer sheet which is sent from the paper feed cassette 16 by the paper feed roller 27 and timed to the formation of the aforementioned color toner image by the timing roller 28. A high voltage, the polarity of which is inverse to that of the toner, is impressed on the transfer unit 24 so that transfer can be conducted.

The transfer sheet onto which the color toner image is transferred, is positively separated from the photoreceptor belt 17 which is sharply curved around the drive roller 18, and then the transfer sheet is conveyed upward by the conveyance belt 29. The conveyance belt 29 is provided with a suction means 291, and the transfer sheet is positively conveyed upward while it is sucked by the suction means 291. Then, the toner image on the transfer sheet is thermally fixed by the fixing roller 30. After that, the transfer paper is discharged onto the upper surface of the upper cover 11 which is also used for a discharge paper tray.

After the toner image has been transferred onto the transfer paper, the photoreceptor belt is further rotated clockwise, and the residual toner on the photoreceptor belt is removed by the cleaning blade 251 of the cleaning means 25 which is contacted with the photoreceptor belt 17 with pressure. After cleaning has been completed, the cleaning blade is separated again from the surface of the photoreceptor belt 17 so that a new image forming process is started.

Next, a jam detecting sensor will be explained as follows.

In FIG. 1, jam detecting sensors $S_1$, $S_2$, $S_3$, $S_4$ are provided in the passage of the transfer paper. The jam detecting sensors are photosensors and check whether a transfer paper is passing in the passage or not. According to the result of the detection conducted by the jam detecting sensors, a jam judging section detects the occurrence of a jam. This jam judging section detects the occurrence of a jam according to a conventional method in such a manner that: when the passage of a transfer paper can not be detected for a predetermined period of time, or when the existence of a transfer paper is detected for a period of time longer than a predetermined value, it is judged that a jam has occurred. Jam detecting sensors $S_1$, $S_2$, $S_3$, $S_4$ detects: whether a transfer sheet is fed from the cassette 16 or not; whether the transfer sheet is positively conveyed by the timing roller 28 or not; a toner image is positively separated after transfer or not; and the transfer paper is positively discharged by the paper discharge roller 31 or not. It should be understood that the arrangement of jam detection sensors is not limited to the specific embodiment, and a jam detection sensor may be installed which can detect whether a transfer sheet is wound around the fixing roller or not. Paper detecting sensor $S_0$ detects whether transfer sheets are in the paper cassette 16 or not, when the paper cassette 16 is provided to the apparatus body 10. The following sensors may be used for jam detection sensors $S_1$–$S_4$ and paper sensor $S_0$: a reflection type of photocoupler which has been shown in this embodiment; a transmission type of photocoupler; a non contact type of reed switch; and a contact type of microswitch.

Referring now to FIG. 2–FIG. 6, the drive system of the process cartridge 15, the drive system of movement of the process cartridge, and the drive system of movement of the cassette will be explained as follows.

Figure 2:
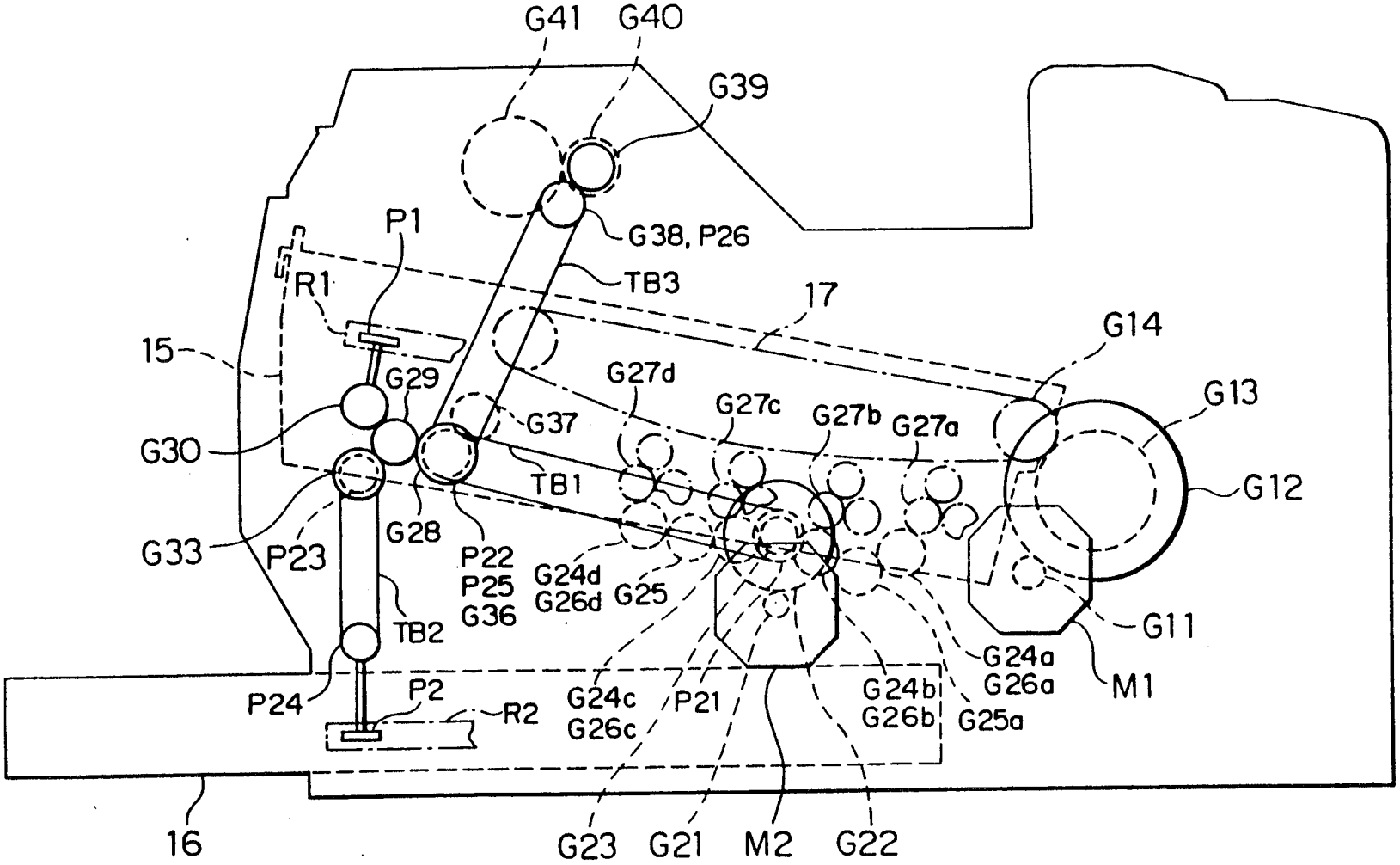
FIG. 2 is a view showing the right side of the drive system relating to the present invention.

FIG. 2 is a view showing the right side of the drive system of the process cartridge 15, the drive system of movement of the process cartridge, and the drive system of movement of the cassette. The aforementioned three drive systems in this embodiment are driven by two motors, M1 and M2.

The drive system of the photoreceptor belt 17 is driven by motor M1. Gear G12 meshes with gear G11 mounted on the shaft of motor M1. When the process cartridge 15 is placed in a position where image formation can be conducted, drive gear G14 which is provided to the same shaft as that of the drive roller 18, meshes with gear G13 which is rotated integrally with gear G12. Namely, the rotation of motor M1 is transmitted to drive gear G14 through gears G11, G12, and G13 so that the rotation speed can be adjusted to an appropriate value. The rotation of motor M1 is further transmitted to the drive roller 18 so that it can be rotated together with drive gear G14 counterclockwise in the drawing, and the photoreceptor belt 17 can be rotated.

Figure 3:
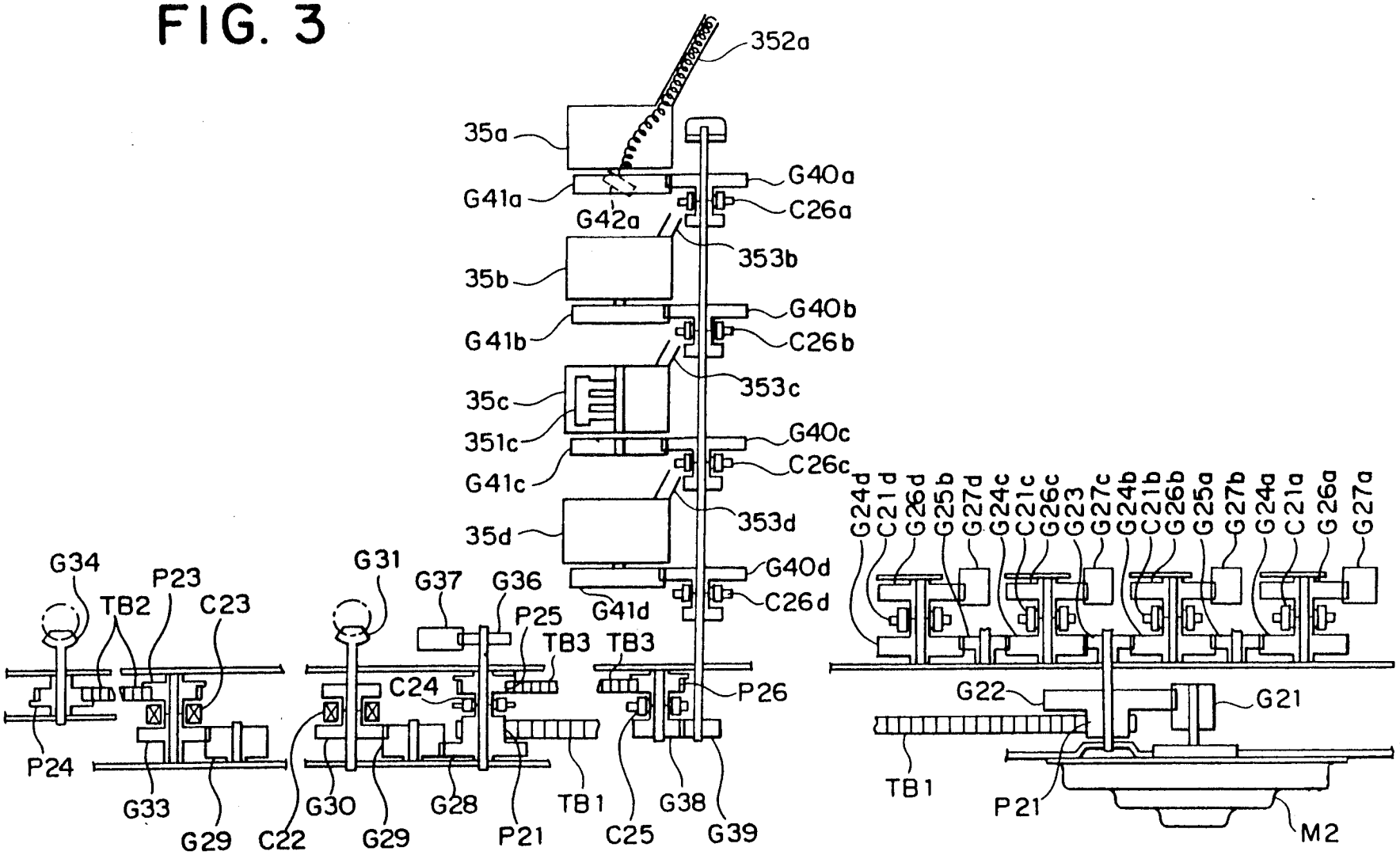
FIG. 3 is a schematic illustration showing drive systems of a process cartridge and a cassette.
Figure 4:
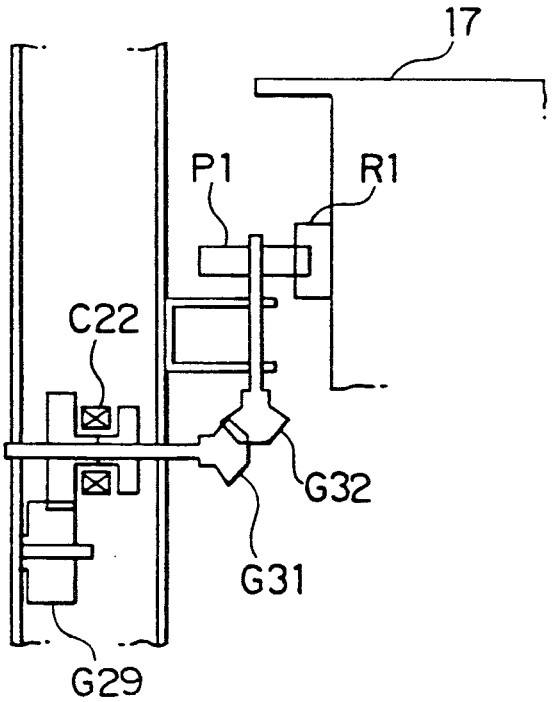
FIG. 4 is a view showing the essential portion of the drive system of the process cartridge.
Figure 5:
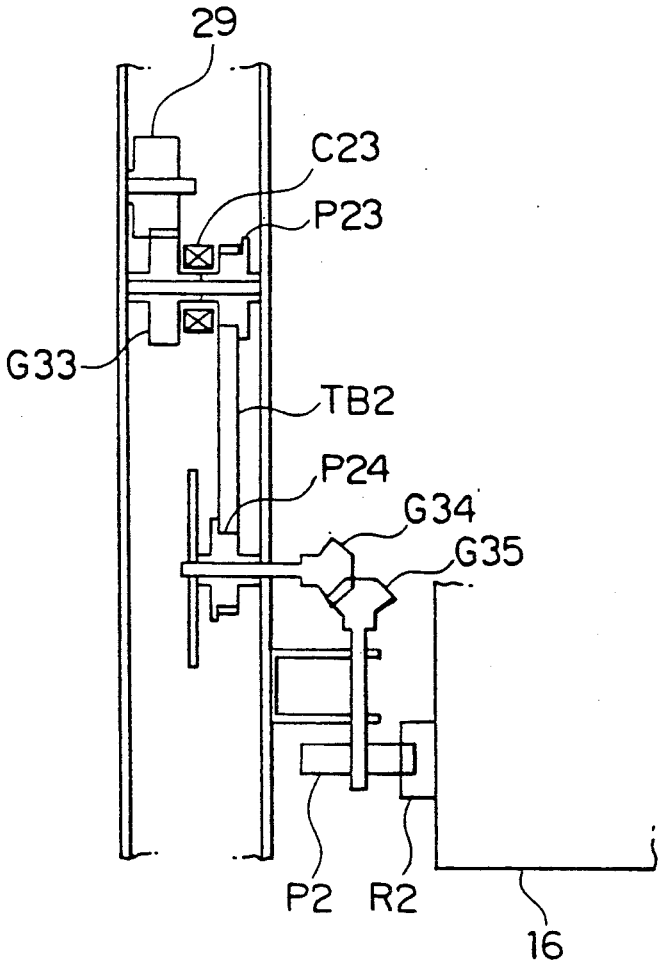
FIG. 5 is a view showing the essential portion of the drive system of the cassette.

Referring to FIG. 2 and FIG. 3, the drive system of the developing units 23a–23d, that of the used toner screw 261, that of the toner hopper 35, that of the movement means of the process cartridge, and that of the movement means of the cassette, will be explained as follows.

In this drive system, motor M2 is utilized. The rotation of motor M2 is transmitted to gear G22 through gear G21 provided to the shaft of motor M2. The rotation is further transmitted to gear G23 which is integrally provided to the same shaft as that of gear G22 so that the drive system of the developing units 23a–23d can be driven.

The drive system of the developing units 23a–23d will be explained as follows.

The rotation of motor M2 which has been transmitted to gear G23, is transmitted to gears G24b and G24c, and further transmitted to gears G24a and G24d through gears G25a and G25b. Further, gear G26a–gear G26d are provided to the same shafts as those of gear G24a–gear G24d through the open type of spring clutches C21a–C21d, and when the process cartridge 15 is located in a position where image formation can be conducted, gear G26a–gear G26d are provided in such a manner that they can mesh with the developing unit drive gears G27a–G27d which are provided to the process cartridge 15. The rotation transmitted to developing unit drive gears G27a–G27d, is transmitted to the developing sleeves 231a231d and the stirring screws 232a–232d through gears provided to the process cartridge 15, so that the developing units can be driven. Specifically, the rotation of motor M2 is transmitted to gears G24b and G24c through gears G21, G22, and G23. Further, the rotation is transmitted to gears G24a and G24b through gears G25a and G25b. When necessary, the clutches are connected, so that the rotation is transmitted to developing unit drive gears G27a–G27d and the developing units 23a–23d are driven. When image formation is being conducted, only one of the developing units 23a–23d corresponding to the color, the image of which is being formed, is driven, and while the process cartridge 15 is being moved, the developing units 23a–23d are not moved. Therefore, control is preferably conducted as follows: cams are provided to the developing units; the cams are provided with claws which come into contact with ratchets (not shown in the drawing) of the clutches C21a–C21d; the phases of the cams are different from each other; 5 selecting positions including a neutral position in which any clutch is not connected, is provided; and the cams are controlled by a stepping motor (not shown in the drawing). For example, the aforementioned control is conducted as follows: 4 cams having a claw, the phase difference of which is 72°, are provided on the same shaft, wherein each cam corresponds to each clutch; and when the stepping motor is rotated by an angle of 72°, only one of the developing units 23a–23d is driven of none of them are driven.

Next, the movement means of the process cartridge will be explained as follows.

The rotation of motor M2 transmitted to gear G22 is transmitted to pulley P22 through rotating pulley P21 and timing belt TB1, and the rotation is also transmitted to gear G29 which meshes with gear G28 rotating integrally with pulley P22. The rotation transmitted to gear G29 is further transmitted to gear G30 which meshes with gear G29. When necessary, the rotation is transmitted to gear G31 through electromagnetic clutch C22. Gear G31 and gear G32 are bevel gears, and the rotation transmitted to gear G31 is transmitted to pinion P1 (Refer to FIG. 4.). The aforementioned pinion P1 can mesh with rack R1 which is provided on the side of the process cartridge 15, and the process cartridge 15 is laterally moved when pinion P1 is rotated and rack R2 is slid. The movement of the process cartridge 15 will be explained in detail later.

Next, the movement means of the cassette will be explained

The rotation of motor M2 transmitted to gear G29 is transmitted to gear G33 which meshes with gear G29. When necessary, the rotation is transmitted to pulley P22 through electromagnetic clutch C23, and the rotation is further transmitted to pulley P24 through timing belt TB2. Furthermore, the rotation is transmitted to gear G34 which is rotated integrally with pulley P24. Gear G34 and gear G35 are bevel gears, and the rotation transmitted to gear G34 is transmitted to pinion P2 (Refer to FIG. 5.). The aforementioned pinion P2 can mesh with rack R2 which is provided on the side of the cassette 16, and the cassette 16 is laterally moved when pinion P2 is rotated and rack R2 is slid. The movement of the cassette 16 will be explained in detail later.

Next, the drive system of used toner recovery will be explained as follows.

When necessary, the rotation of motor M2 transmitted to pulley P22, is transmitted to pulley P25 through the open type of spring clutch C24 so that the drive system of the used toner screw 261 is driven.

Concerning the drive system of the used toner screw 261, gear G36 which rotates integrally with pulley P25, meshes with used toner screw drive gear G37 which is provided on the side of the process cartridge 15, so that the rotation transmitted to pulley P25 can be further transmitted to the used toner screw 261. The used toner screw 261 conveys the residual toner, which has been removed from the photoreceptor belt 17 by the cleaning means 25, to the toner recovery box 26 through the toner recovery pipe 262 inside which a coil spring is provided.

Next, the drive system of the toner hoppers 35a–35d will be explained as follows.

The rotation of motor M2 transmitted to pulley P25 is transmitted to pulley P26 through timing belt TB3, and when necessary, the rotation is transmitted to gear G38 through spring clutch C25, and further transmitted to gear G39 which meshes with gear G38. When necessary, spring clutches C26a–C26d are connected so that gears G41a–G41d are rotated which mesh with gears G40a–G40d rotating integrally with gear G39. Then, the toner hopper stirring members 351a–351d are rotated together with gears G41a–G41d so that the toner in the toner hoppers 35a–35d is stirred. At the same time, the toner screws 352a–352d are rotated which are provided to the same shaft as that of gears G42a–G42d which mesh with gears G41a–G41d, so that the toner is conveyed to the developing units 23a–23d in the process cartridge 15. The toner hoppers 35a–35d are driven in accordance with the drive of the aforementioned developing units 23a–23d. That is, when a developing unit of a color is being driven, only the toner hopper corresponding to the color is driven so that the toner of the color can be supplied. Spring clutches C26a–C26d are used are used for the aforementioned control, and a stepping motor and cam (which are not illustrated in the drawing) are utilized in the same manner as the control of the drive of the developing unit.

In this embodiment, two motors M1 and M2 are used to drive the units as follows. The drive system of the photoreceptor belt 17 is driven by motor M1, and the drive system of the developing units 23*a*–23*d*, the used toner screw 261, the toner hopper 35, the process cartridge moving means, and the cassette moving means, is driven by motor M2. These units may be driven by one motor. Otherwise, the process cartridge moving means and the cassette moving means may be respectively provided with an exclusive motor.

Figure 6:
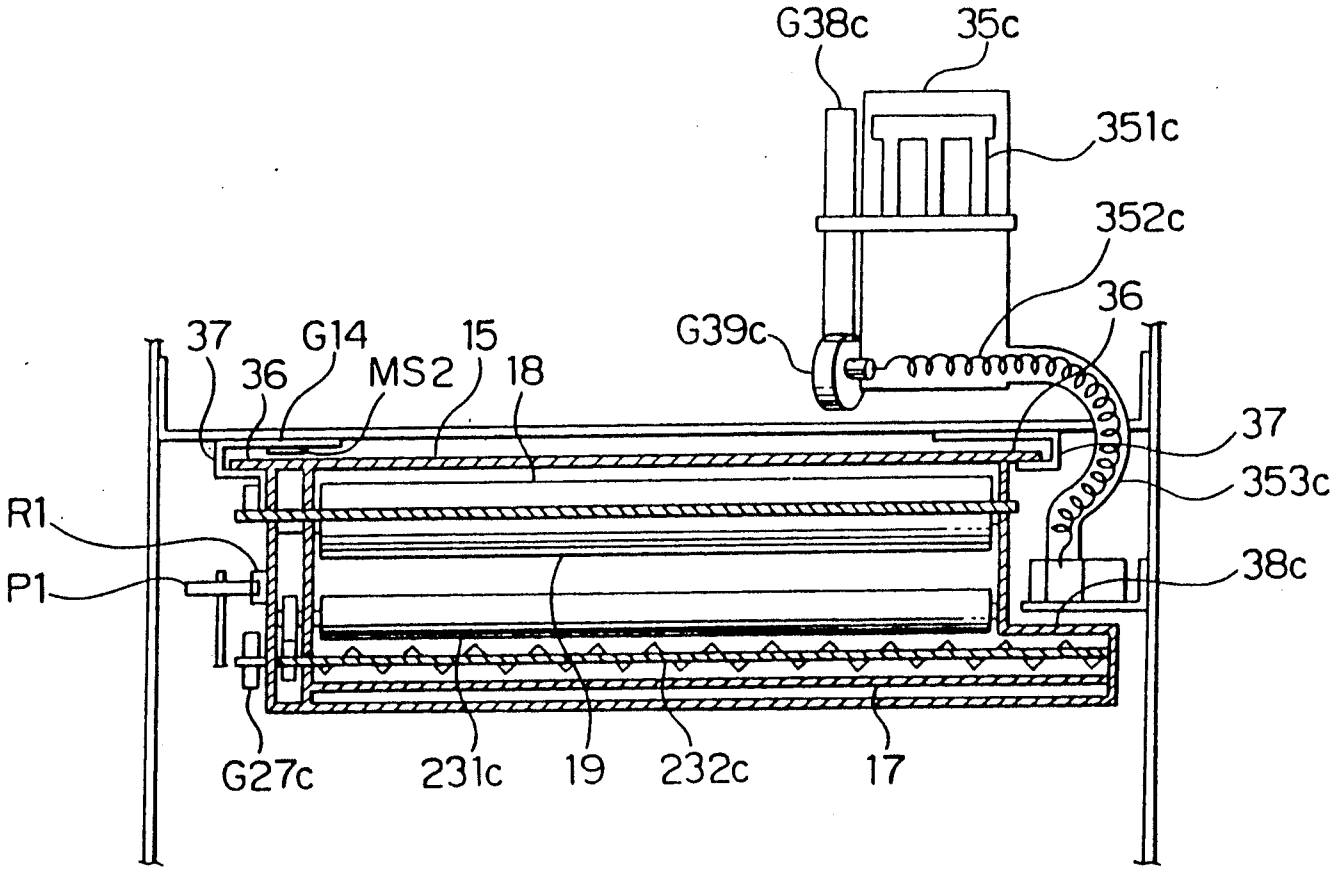
FIG. 6 is a sectional view taken on line A—A in FIG. 1.

Referring to FIG. 6 which is a sectional view taken on line A—A in FIG. 1, and referring to FIGS. 7-*a*–7-*c* which are schematic drawings of a model of movement of the process cartridge 15, the movement of the process cartridge 15 will be explained as follows.

The protruded member 36 and rack R1 used for movement are provided on the side of the process cartridge 15. Further, drive gear G14 used for image formation, drive gears G27*a*–G27*d* to drive the developing units, and drive gear G37 to drive the used toner screw, are provided in the process cartridge 15.

The following are provided in the process cartridge holding chamber in the apparatus body 10: the guide member 37 which engages with the protruded member 36 of the process cartridge 15 so that the process cartridge can be suspended; and gear G13, gears G26*a*–G26*d*, and gear G36 which correspond to gear G14 to drive the process cartridge 15, gears G27*a*–G27*d* to drive the developing units, and gear G34 to drive the used toner screw. Pinion P1 is provided in such a manner that pinion P1 can mesh with rack R1 mounted on the process cartridge 15. The first microswitch MS1 and the second microswitch MS2 are mounted on the aforementioned guide member 37. The aforementioned first microswitch MS1 and the second microswitch MS2 are detection means to detect the position of the process cartridge 15. In this case, the first microswitch MS1 detects the first position in which image formation can be conducted in such a manner that: drive gear G14, gears G27*a*–G27*d* to drive developing units, and gear G37 to drive the used toner screw, which are provided to the process cartridge 15, mesh with gear G13, gears G26*a*–G26*d*, and gear G36, which are provided to the apparatus body 10. The second microswitch MS2 detects the second position which is further apart from the transfer unit 24 as compared with the first position, in other words, the second position is defined as a position to which the process cartridge 15 is withdrawn in the opposite direction of the process cartridge insertion. The microswitches MS1 and MS2 outputs the positional signal to the control section. In this case, the position is determined so that the gravity center of the process cartridge 15 can be located inside the apparatus 10. The reason is as follows: when the gravity center of the process cartridge 15 is located outside the apparatus 10, rack R1 does not mesh with pinion P1 appropriately, so that it becomes difficult to attach the process cartridge to the apparatus or detach the cartridge from the apparatus. The position detecting sensor used to detect the first and second position is not limited to the microswitch. Various sensors such as a photoconductive switch and a magnetic switch may be used. The first microswitch MS1 and the second microswitch MS2 are not necessarily provided to the guide member 37. They may be provided to the apparatus body 10 as far as they can detect the first and second position.

First, a case in which the process cartridge 15 is taken out from the apparatus 10 will be explained. As shown in FIG. 7-*a*, the process cartridge 15 is in the first position so that the distance between the drive roller 18 and the transfer unit 24 is maintained to be a predetermined value (in the case of a transfer drum, appropriate contact pressure is maintained). Drive gear G14, gears G27*a*–G27*d* to drive developing units, and gear G37 to drive the used toner screw, which are provided to the process cartridge 15, mesh with gear G13, gears G26*a*–G26*d*, and gear G36, which are provided to the apparatus body 10, so that the apparatus is in the most optimum state for image formation. Rack R1 meshes with pinion P1.

The jam judging section receives the signal sent from jam detection sensors $S_1$–$S_4$, and judges whether a jam has occurred or not. When it is judged that a jam has occurred, the jam judging section sends a jam signal to the control section. Then, the control section stops the drive sections for image formation such as the photoreceptor belt drive section, the developing unit drive section, and the fixing unit drive section. At the same time, the control section controls the process cartridge moving means. In other words, the control section moves the process cartridge 15 in the direction of the second position along the guide member 37 in such a manner that: the control section sends a signal to motor M2 and electromagnetic clutch C22 which are the drive section of the process cartridge moving means, so that pinion Pl can be rotated in order to move the process cartridge 15 from the first to the second position and the process cartridge 15 is moved along the guide member 37 in the direction of the second position. (Refer to FIG. 7-*b*.)

Figure 7A:
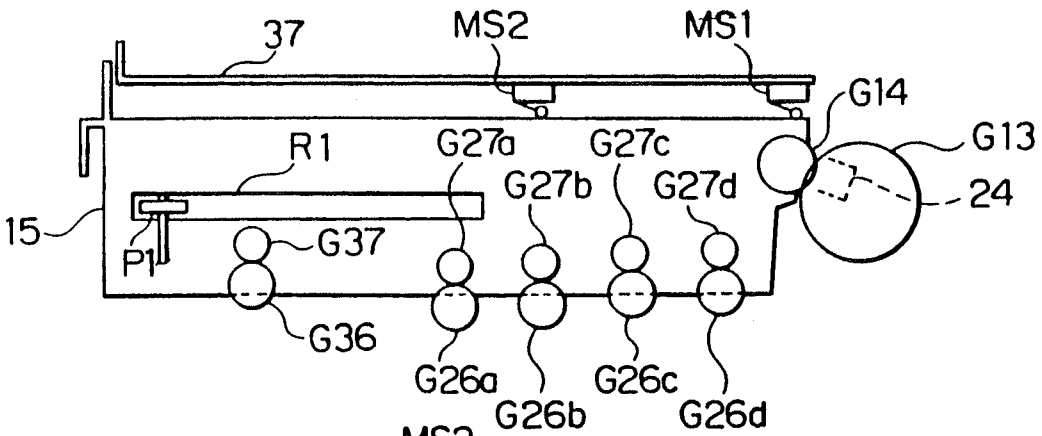
FIG. 7-*a* to FIG. 7-*c* are schematic illustrations showing a model of the movement of the process cartridge.
Figure 7B:
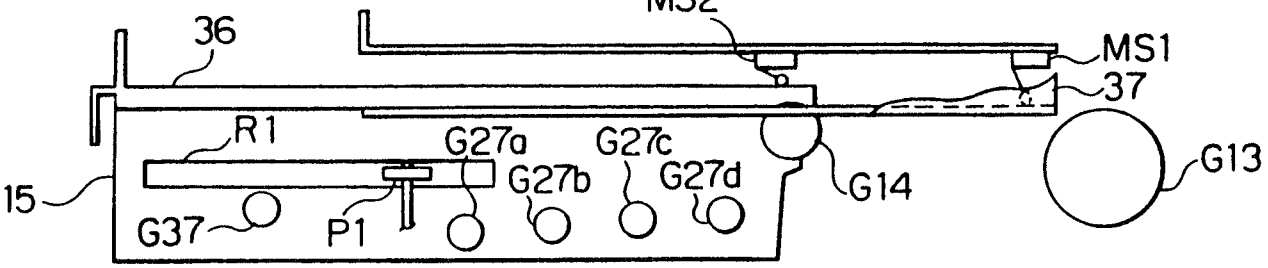
Figure 7C:
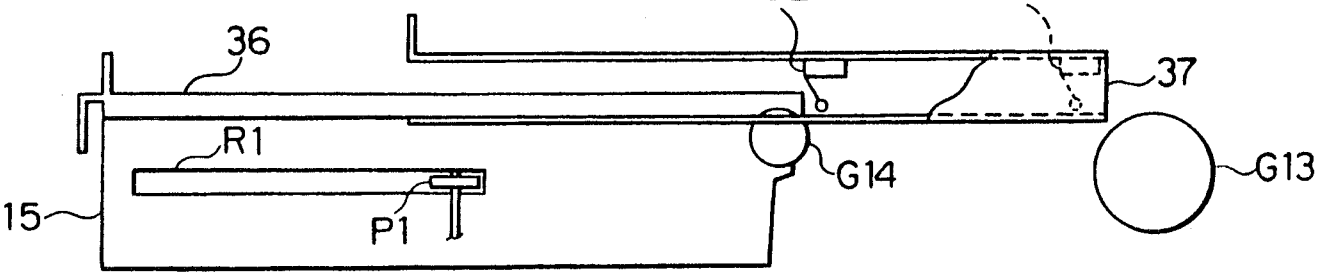

When the process cartridge 15 is moved as shown in FIG. 7-*c*, the second microswitch MS2 detects that the process cartridge 15 has moved to the second position, and the detection signal is sent to the control section. When the signal is inputted into the control section, the control section releases electromagnetic clutch C22 and stops the rotation of motor M2. That is, the process cartridge 15 withdraws from the first position to the second position and stops at the second position while rack R1 meshes with pinion P1. The front cover 14 is composed in such a manner that the movement of the process cartridge is not interrupted.

The process cartridge 15 is inserted into the apparatus body 10 in such a manner that: the protruded portion 36 of the process cartridge 15 is slid along the guide member 37 provided in the process cartridge holding chamber while rack R1 meshes with pinion P1; and the process cartridge 15 is inserted until it comes to the second position. (Refer to FIG. 7-*c*.)

In order to move the process cartridge 15 from the aforementioned position to the first position in which image formation is possible, the process cartridge 15 located in the second position is further inserted into the apparatus, or a setting button on the operation panel 11 is pressed so that a setting signal can be inputted into the control section. When the setting signal is inputted into the control section, the control section sends a signal to motor M2 and electromagnetic clutch C22, and pinion P1 is rotated in order to move the process cartridge 15 from the second position to the first position so that the process cartridge 15 is moved along the guide member 37 in the direction of the first position (FIG. 7-*b*).

When the process cartridge 15 is moved, the first microswitch MS1 detects that the process cartridge 15 has moved to the first position as illustrated in FIG. 6, and the signal is sent to the control section from the microswitch MS1. When the signal is inputted into the control section, the control section releases electromagnetic clutch C22 and stops the rotation of motor M2. Namely, the process cartridge 15 stops at the first position, and drive gear G14, gears G27*a*–G27*d* to drive the developing units, and gear G37 to drive the used toner screw gear, which are provided to the process cartridge 15, mesh with gear G13, gears G26*a*–G26*d*, and gear G36, which are provided in the apparatus body 10, so that image formation becomes possible. At this time, toner supply ports 38*a*–38*d* of the developing units 23*a*–23*d* provided in the process cartridge 15, are automatically connected with toner conveyance pipes 353*a*–353*d* of the toner hoppers 35*a*–35*d* so that toner can be supplied to the developing unit.

Since the front cover 14 is pushed by a spring in the direction of closing, the movement of the process cartridge can not be interrupted by the front cover 14. In other words, the front cover 14 is opened when the process cartridge 15 is moved. The front cover 14 may be opened in such a manner that: the front cover 14 which is pushed by a spring is engaged with a solenoid; a signal is sent to the solenoid simultaneously with the signal of process cartridge movement so that the solenoid can be released and the front cover can be opened by the force of the spring. In the case where the front cover is opened by a motor and gear, when the process cartridge 15 is moved front the first position to the second position, the front cover is opened, and when the process cartridge is moved from the second to the first position, the front cover 14 may be automatically closed according to the signal sent from the first microswitch MS1 which detects that the process cartridge has moved to the first position.

Figures 8A, 8B, 8C:
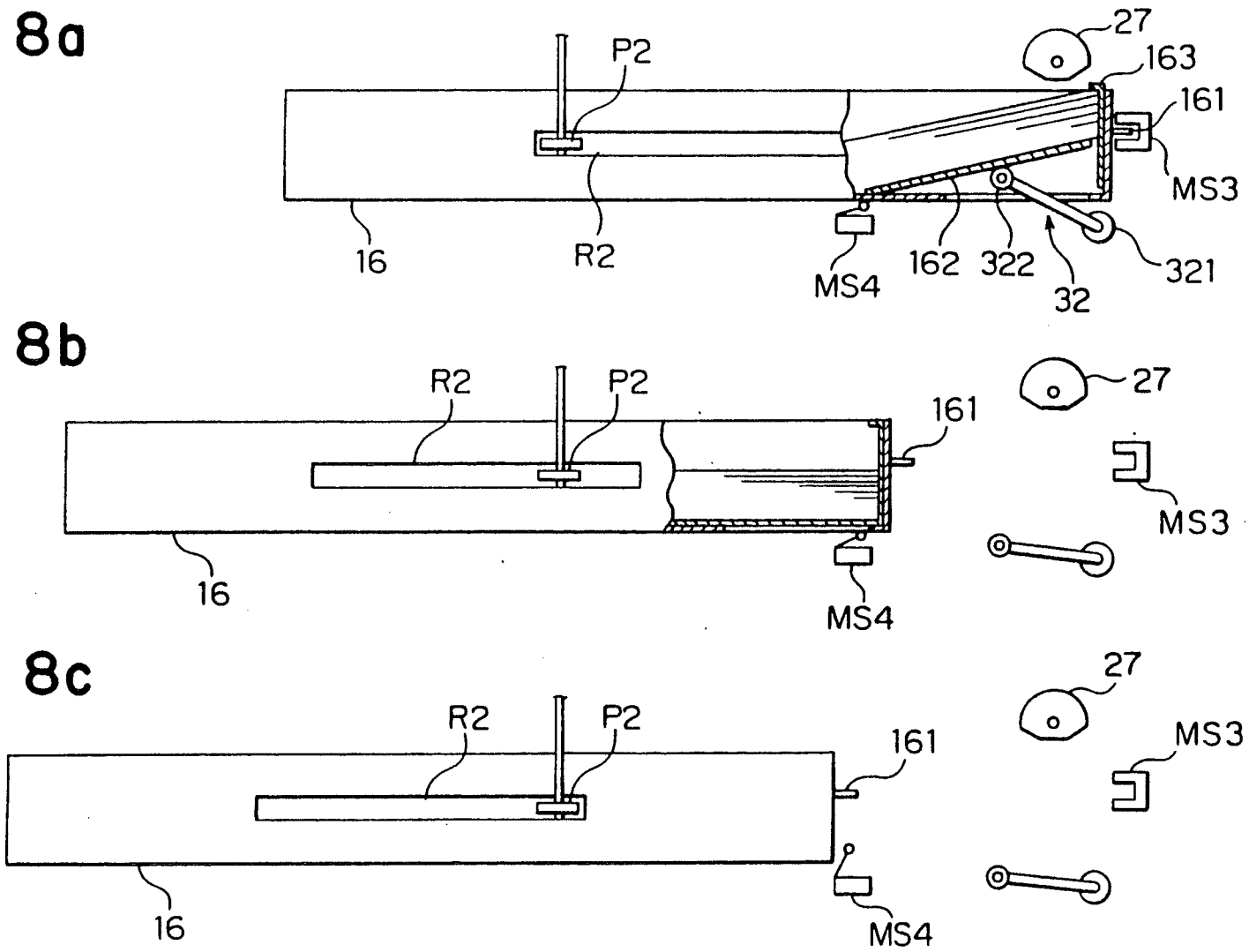
FIG. 8-*a* to FIG. 8-*c* are schematic illustrations showing a model of the movement of the cassette.

Referring now to FIGS. 8-*a*–8-*c* which show a model of the movement of the cassette 16, the movement of the cassette will be explained as follows.

Rack R2 is provided on the side of the cassette 16, and the protrusion 161 is provided in the front portion of the cassette 16 with regard to the inserting direction. The bottom plate 162 on which transfer sheets are stacked, is rotatably provided inside the cassette 16, and the separation claw 163 is slidably provided in the cassette 16.

In the cassette holding chamber of the apparatus body 10 are provided the paper feed roller 27, pinion P2 to move the cassette 16, the push-up lever 32 to push up the bottom plate 162, photoelectric switch MS3 composed of a photocoupler, and microswitch MS4.

The push-up lever 32 is pivotally supported by the push-up mechanism 321 mounted on the apparatus body 10, and the tip of the push-up lever 321 is provided with the roller 322. The push up mechanism may be driven by a lever mechanism or a motor.

Photoelectric switch MS3 and microswitch MS4 are detection means to detect the position of the cassette 16. Photoelectric switch MS3 detects the first position in which the uppermost surface of the transfer sheets in the cassette 16 is pushed up against the separation claw 163 so that the transfer sheet can be supplied. Microswitch MS4 detects the second position to which the cassette 16 is withdrawn from the first position. Then, photoelectric switch MS3 and microswitch MS4 output the positional signals to the control section. In the same manner as the process cartridge 15, the gravity center of the cassette 16 is preferably maintained within the apparatus 10. The positional sensor used to detect the first and second position, is not limited to this embodiment. Various conventional sensors such as a microswitch, a photoelectric switch, and a magnetic switch may be utilized.

In the case where the cassette 16 is taken out from the apparatus, as illustrated in FIG. 8-*a*, the cassette 16 is in the first position so that the transfer paper can be most appropriately fed by the paper feed roller 27. In this case, rack R2 meshes with pinion P2.

In the same manner as the aforementioned movement of the process cartridge 15, when the occurrence of a jam has been detected, the control section sends signals to motor M2 which is the drive section of the cassette moving means, and to electromagnetic clutch C23, so that pinion P2 is rotated in order to move the cassette 16 from the first position to the second position. At this time, the push-up lever 32 is withdrawn under the passage of the cassette 16 so that the push-up lever 32 can not interrupt the movement of the cassette 16 (Refer to FIG. 8-*b*.)

As illustrated in FIG. 8-*c*, when the cassette 16 has been moved, microswitch MS4 detects that the cassette 16 has moved to the second position, and then sends the signal to the control section. When the signal is inputted into the control section, the control section releases electromagnetic clutch C23 and stops the rotation of motor M2. Namely, the cassette 16 withdraws from the first position to the second position, and stops at the second position under the condition that rack R2 meshes with pinion P2.

On the contrary, when the cassette 16 is inserted into the apparatus body 10, the cassette 16 is slid along the cassette holding chamber or the guide member (not shown in the drawing), and rack R2 meshes with pinion P2, and the cassette 16 is inserted until it comes to the second position (Refer to FIG. 8-*c*.)

In order to move the cassette 16 from the aforementioned position to the first position in which paper feed is possible, the cassette 16 located in the second position is further inserted into the apparatus, or a setting button on the operation panel 11 is pressed so that a setting signal can be inputted into the control section. When the setting signal is inputted into the control section, the control section sends a signal to motor M2 and electromagnetic clutch C23, and pinion P2 is rotated in order to move the cassette 16 from the second position to the first position so that the cassette 16 is moved along the guide member 37 in the direction of the first position (FIG. 8-*b*).

When the cassette 16 is further moved, as illustrated in FIG. 8-*a*, photoelectric switch MS3 detects by the protrusion 161 that the cassette has moved to the first position, and sends the signal to the control section. When the signal has been inputted into the control section, electromagnetic clutch C23 is released and the rotation of motor M2 is stopped. The operations are conducted as follows: the cassette 16 stops at the first position; the push-up lever 32 is rotated clockwise by the push-up mechanism 321; the bottom plate in the cassette 16 is pushed up by the roller 322; and the uppermost surface of the transfer sheet stacked on the bottom plate 162 is pressed against the separating claw 163, so that the transfer sheet can be fed by the paper feed roller 27 which is a semicircular roller.

Figure 9A:
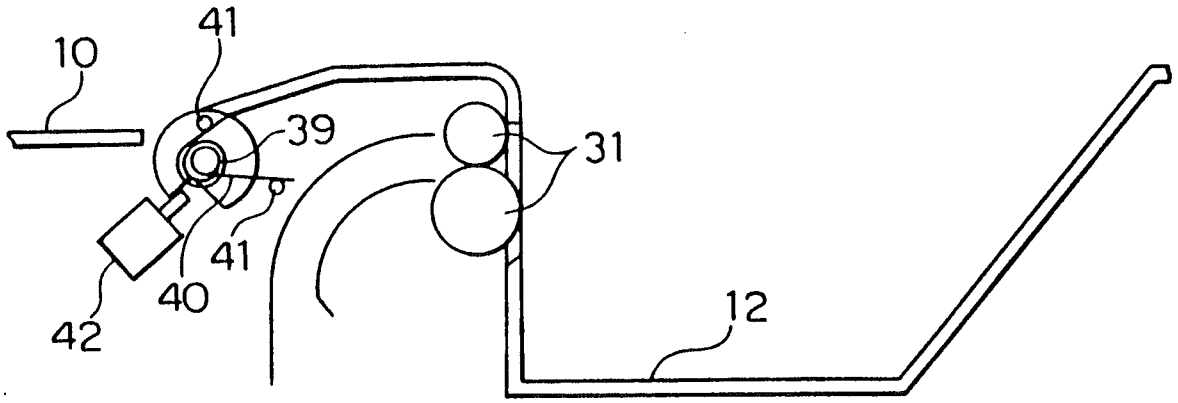
FIG. 9-*a* and FIG. 9-*b* are views showing the release mechanism of the upper cover.
Figure 9B:
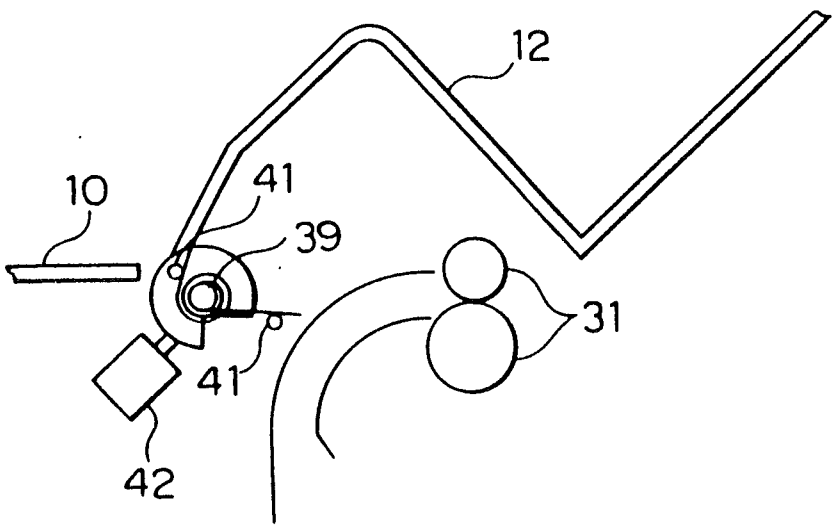

Referring to FIGS. 9-*a* and 9-*b*, the upper cover release means will be explained as follows. The upper cover 12 is pivotally supported by the upper cover shaft 39. The upper cover 12 is pushed so that it can be opened, that is, the upper cover 12 is pushed counterclockwise in the drawing by a helical spring 40 wound around an upper cover shaft 39 and pins 41, one of the pins is provided to the upper cover. A solenoid 42 is provided in such a manner that the upper cover 12 can be locked by the solenoid 42 when the upper cover 12 is closed.

Since the aforementioned upper cover release means is provided, the upper cover 12 is closed when image formation is being conducted. The upper cover 12 is also used for a discharge tray on which transfer sheets are stacked (FIG. 9-*a*). In the case where a jammed transfer sheet is taken care of, when a take-out button on the operation panel 11 is pressed and an image formation process signal is not outputted, the control section outputs a moving signal to the process cartridge moving means in order to move the process cartridge 15, and at the same time, outputs a release signal to the solenoid 42 which is the upper cover release means. When the release signal has been inputted into the solenoid 42, the shaft of the solenoid 42 is moved backward, in other words, the lock of the upper cover 12 is released. Then, the upper cover 12 which has been pushed by the spring, is opened by the spring force (FIG. 9-*b*). Since the upper cover 12 is opened in the manner described above, the jammed transfer sheet can be easily found and taken out. It should be understood that the upper cover release means is not limited to this embodiment. The upper cover shaft 39 may be provided with a gear, and a motor to mesh with the gear may be provided so that the motor can be rotated by a release signal sent from the control section in order to open the upper cover 12. In this case, the motor may be rotated in the reverse direction so that the upper cover can be closed when a set signal is inputted into the control section. In the aforementioned embodiment, explanations have been conducted on the image forming apparatus provided with the upper cover 12 However, the present invention is not limited to this embodiment. In the case of a clam-shell type of image forming apparatus, the release means can be provided to the upper housing instead of the upper cover 12.

Figure 10:
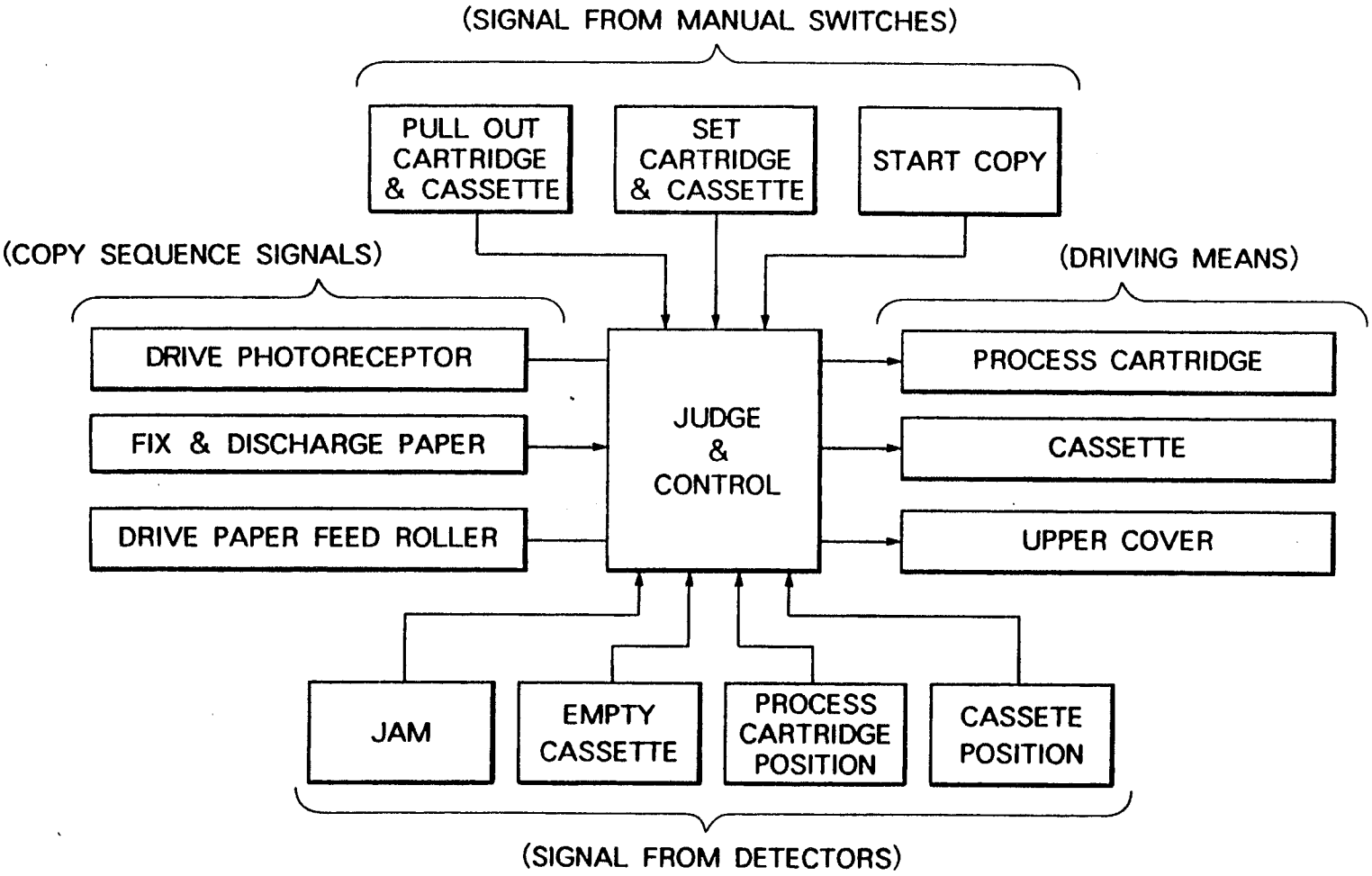
FIG. 10 is a view showing the control system.
Figure 11:
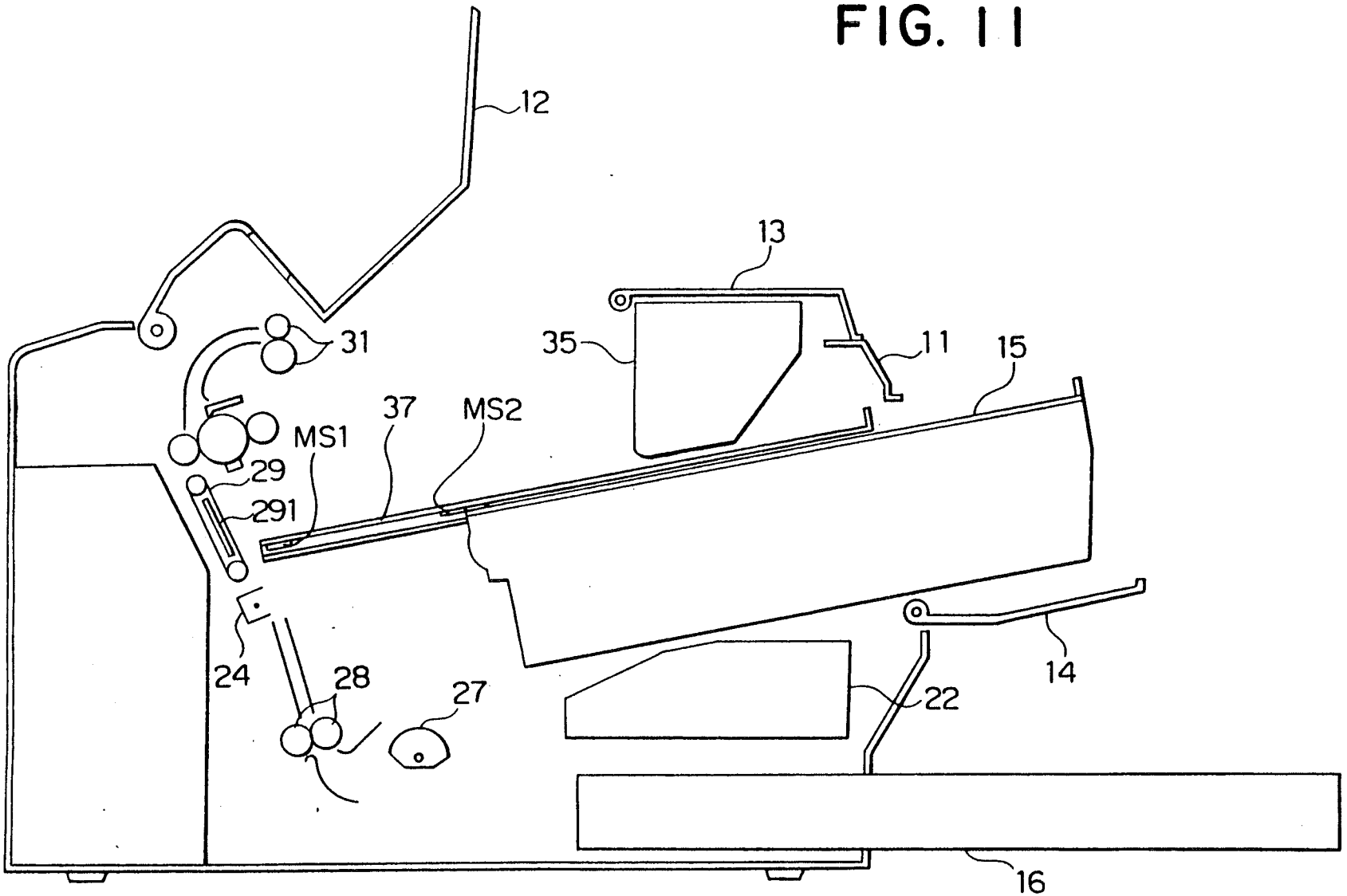
FIG. 11 is a left side view of the color printer when the process cartridge is in the second position.

FIG. 10 is a block diagram showing the control of movement of the process cartridge 15 and the cassette 16, and showing the control of opening operation of the upper cover 12. The signals sent from jam detection sensors S1–S4 are judged by a jam judging section whether a jam has occurred or not. When it is judged that a jam has occurred, the jam judging section outputs a jam signal to the control section. Then, the control section stops the operation of a drive section relating to image formation such as a photoreceptor belt drive section, a developing unit drive section, and a fixing unit drive section. Further, the control section outputs a signal to the process cartridge moving means and the cassette moving means so that the process cartridge and cassette can be moved. The process cartridge moving means controls the process cartridge drive system in order to move the process cartridge 15 from the first to the second position, and when it is detected that the process cartridge 15 has been moved to the second position, the motion of the process cartridge drive system is stopped. In the same manner, the cassette moving means moves the cassette 16 from the first to second position. On the other hand, the upper cover opening means opens the upper cover 12. In other words, when a jam has occurred, the process cartridge 15 and the cassette 16 are withdrawn to the second position as shown in FIG. 11 without any operations by an operator, and at the same time, the upper cover 12 is opened, so that the jammed transfer sheet can be easily checked from the upper portion of the apparatus body 10 and removed from the apparatus. After the jammed transfer sheet has been removed from the apparatus, the process cartridge 15 and the cassette 16 are automatically inserted into the apparatus by a simple operation, so that the labor of the operator can be greatly lessened, and the process cartridge 15 and the cassette 16 can be set to an appropriate position.

When it is detected by sensor $S_0$ that all the transfer sheets have been sent out, the aforementioned control section can move only the cassette 16. When the process cartridge 15 is replaced or the transfer sheets are replenished, the take-out button provided on the operation panel 11 is pressed so that the take-out signal can be inputted into the control section. When a photoreceptor drive signal, a fixing and paper discharging drive signal, and a paper feed drive signal are not sent out at this time, the process cartridge 15 and/or the cassette 16 can be moved from the first to the second position.

In this embodiment, the present invention is applied to the image forming process in which a color toner image formed on a photoreceptor belt is transferred onto a transfer sheet when the photoreceptor belt is rotated by one revolution. However, the present invention may be applied to the image forming process in which a toner image is superimposed on a toner image previously transferred onto a transfer drum. The present invention can be also applied to a conventional monochrome printer in which a monochrome process is utilized. In the aforementioned embodiment, a non-contact developing method is adopted. However, it should be understood that the present invention is not limited to the non-contact developing method, but it can be applied to a contact developing method. The drive system shown in this embodiment is an example, and the drive system of the present invention is not limited to the specific embodiment.

Figure 12:
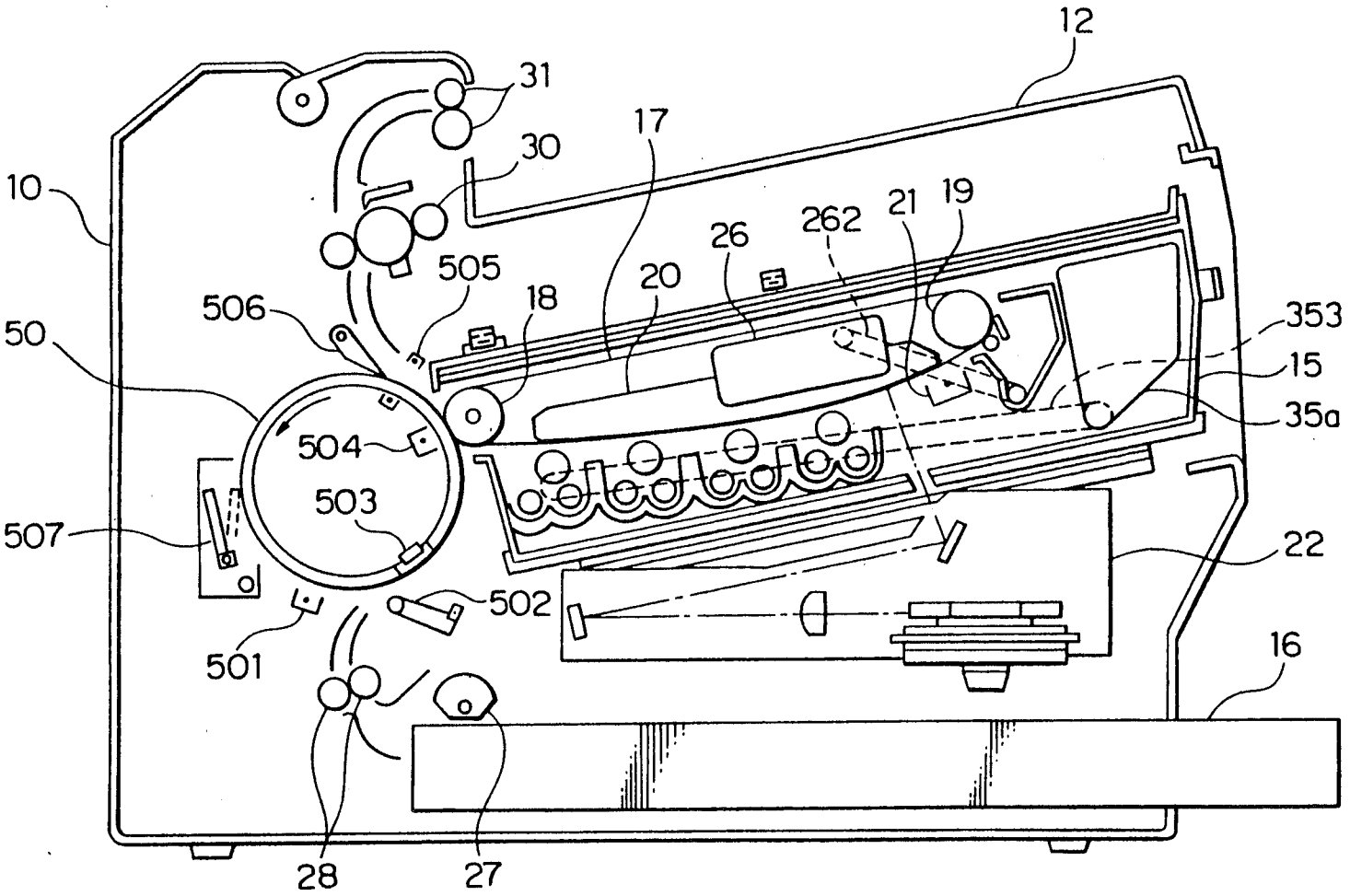
FIG. 12 is an essential sectional view of a transfer drum type of image forming apparats to which the present invention is applied.

FIG. 12 shows a transfer drum type of image forming apparatus which is the second embodiment of the present invention. The structure of the process cartridge 15 is approximately the same as that of the embodiment explained before. In this embodiment, a toner hopper 35*a* is integrally provided in the process cartridge. In the transfer drum type of image forming apparatus, a transfer drum 50 is contacted with the transfer portion of the photoreceptor belt 17, and the transfer drum 50 is rotated counterclockwise synchronously with the photoreceptor belt 17. A transfer sheet is wound around the circumferential surface of the transfer drum 50, and a toner image of each color formed on the photoreceptor belt 17 is transferred onto the transfer sheet wound around the transfer drum so that the toner image can be superimposed, and then the transfer sheet is separated from the transfer drum 50 and the toner image is fixed. After that, the transfer sheet is discharged onto the upper portion of the apparatus body.

A charging unit 501 which electrostatically attracts the transfer sheet and a winding member 502 which mechanically wounds the transfer sheet around the transfer drum 50 are provided in the peripheral portion of the transfer drum 50. A roller is mounted on the tip of the winding member 502, and the roller is contacted with the transfer drum 50 only when the leading edge of the transfer sheet is wound around the transfer drum 50.

A gripper 503 is provided on the circumferential surface of the transfer drum 50 in order to hold the leading edge of the transfer sheet which has been conveyed synchronously. The transfer unit 504 electrostatically transfers the toner image formed on the photoreceptor belt 17 onto the transfer sheet. A discharging electrode 505 and a separating claw 506 separate the transfer sheet from the transfer drum 50 after the toner image has been transferred onto the transfer sheet. A cleaner 507 which can be contacted with or separated from the transfer drum 50, removes the residual toner on the transfer drum 50.

A yellow toner image is transferred onto a transfer sheet in such a manner that: the transfer sheet which has been fed from the cassette 16 is synchronously conveyed to the transfer drum 50 which has been charged by the charging unit 501; the transfer sheet is wound around the transfer drum 50 by the winding member 502; the leading edge of the transfer sheet is held by the gripper 503; the transfer sheet is rotated together with the transfer section of the photoreceptor belt 17; and the yellow toner image formed on the photoreceptor belt 17 is transferred onto the transfer sheet by the transfer unit 504. After the first transfer operation has been completed, the transfer drum 50 is continuously rotated and cleaned by the cleaner 507, and then the next toner image is transferred. A magenta toner image is transferred in the second rotation of the transfer drum 50, a cyan toner image is transferred in the third rotation, and a black toner image is transferred in the fourth rotation in such a manner that each toner image is superimposed. After 4 toner images has been transferred, the transfer sheet is discharged by the discharging electrode 505, and the leading edge of the transfer sheet is released by the separating claw 506, and then the transfer sheet is conveyed to the fixing roller 30.

In the image forming apparatus of this embodiment, the transfer drum 50 is provided on the apparatus body 10 side, so that it is not integrated in the process cartridge 15. Accordingly, the process cartridge 15 is moved in the same manner as the aforementioned embodiment.

As explained above, in the embodiment of the present invention, when a jam has occurred, the process cartridge is automatically withdrawn from the image forming position, and the cassette is also automatically withdrawn form the paper feed position, and at the same time the upper cover is opened. On the other hand, when the process cartridge and cassette are inserted into the apparatus body, they can be automatically set to the most optimum position.

As described above, in the image forming apparatus of this embodiment, when a jam has occurred, the process cartridge and cassette are automatically moved, and at the same time the upper cover is opened, so that the labor of an operator can be lessened. When a jam has occurred, the process cartridge and cassette are withdrawn to the second position and the upper cover is opened, so that the operator can easily check the position where the jam has occurred. Consequently, a wide work space can be ensured, and the work efficiency of jam treatment can be improved. Further, there is no possibility of damaging the surface of an image carrier when the jammed paper is removed, and it is not necessary for an operator to touch the surface of the image carrier. Furthermore, the process cartridge is mechanically moved, so that the process cartridge is not vibrated unnecessarily, and when the process cartridge is replaced or moved in order to remove a jammed paper, the developer is scarcely scattered and maintainability can be improved.

Even in the case of a color printer, all of the operations such as cassette installation, jam treatment, and toner supply, can be conducted from the front side of the apparatus, so that high maintainability can be realized in the same manner as a monochrome printer.

Next, the third embodiment of the present invention will be explained as follows. In this embodiment, when it is detected that the upper cover has been opened, the cassette is moved from the first position where transfer sheets can be fed from the cassette, to the second position. When the upper cover is closed while the cassette is set in the second position, the cassette is automatically moved to the first position so that the transfer sheet can be fed from the cassette. Many other points are approximately the same as the first embodiment, so that the explanations will be omitted in principle. If necessary, the explanations will be conducted referring to the attached drawing.

Figure 13A:
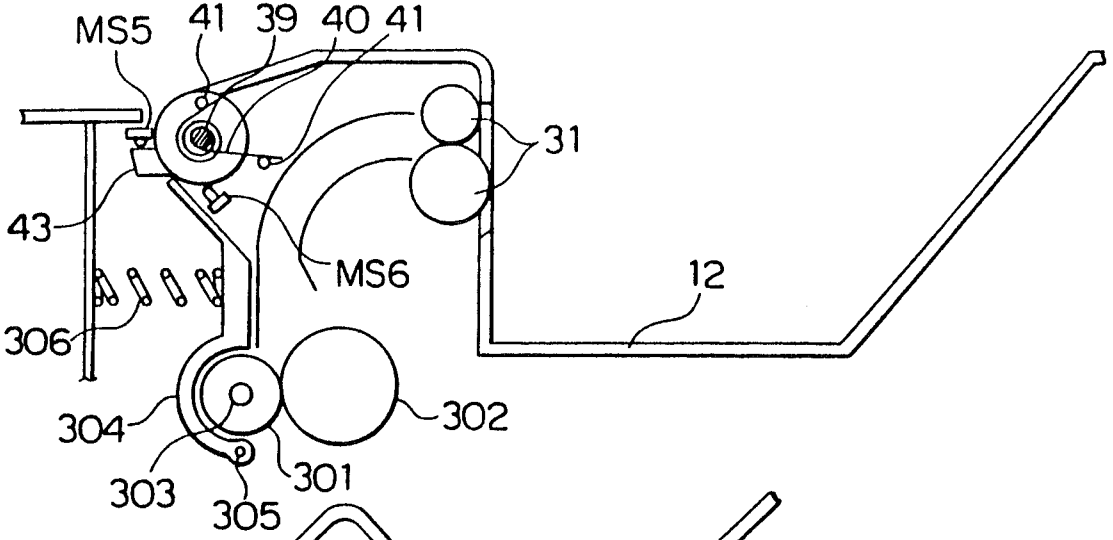
FIGS. 13-*a* and 13-*b* are views showing the release mechanism of the upper cover.
Figure 13B:
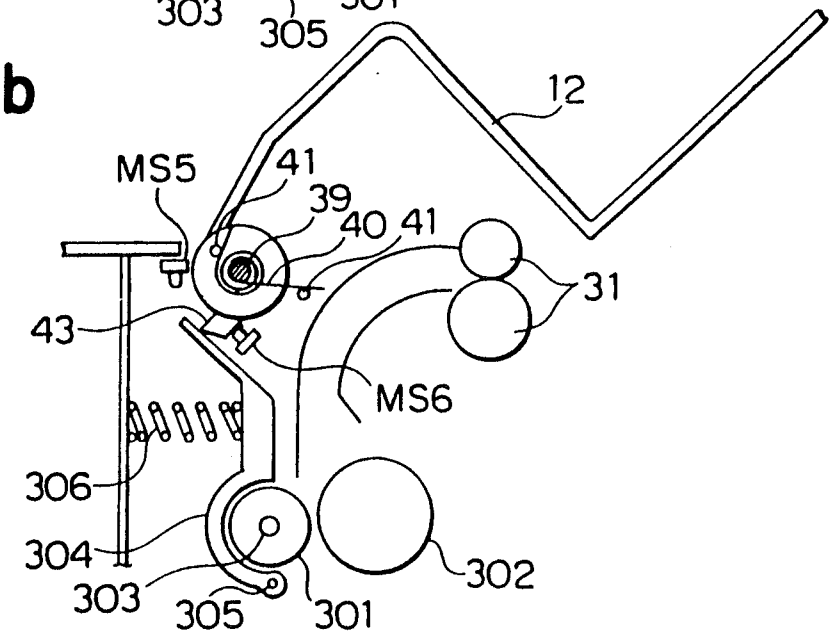

Referring to FIGS. 13-*a*, 13-*b*, the upper cover opening means of this embodiment will be explained as follows. An upper cover 12 is pivotally supported by an upper cover shaft 39. The upper cover 12 can be opened, in other words, the upper cover 12 is pushed so that it can be rotated counterclockwise in the drawings, by a helical spring 40 wound around the upper cover shaft 39 and two pins, one is mounted on an apparatus 10, and the other is mounted on the upper cover 12. The apparatus 10 is provided with microswitches MS5, MS6 which detect the closing and opening of the upper cover 12. A locking member (not illustrated in the drawing) is provided which can lock the upper cover 12 when it is closed. When the upper cover 12 is closed during the process of image formation, the upper cover 12 is also utilized for a discharged paper tray on which a transfer paper discharged by a discharging roller 31 is stacked (FIG. 13-*a*).

In order to remove a jammed paper from the apparatus, the lock member not shown in the drawing is released, and then the upper cover 12 which has been pushed by a spring, is opened by the spring force (FIG. 13-*b*). Then, microswitch MS6 detects that the upper cover 12 has been opened, and outputs a release signal to the control section. On the other hand, when a jam treatment has been completed, the operator closes the upper cover 12, and then microswitch MS5 detects that the upper cover 12 has been closed, and the closing signal is outputted to the control section. The moving control and mechanism of the process cartridge and cassette after the aforementioned opening and closing signal have outputted, are the same as those in the first embodiment. The structure of the upper cover opening means is not limited to the specific embodiments, and a lock member may be provided which can be engaged with the upper cover 30 itself. These engaging member may be replaced with a solenoid. Further, the upper cover shaft 39 may be provided with a gear and a motor to mesh with, and the motor may be rotated by a command signal sent from the operation panel 11 so that the upper cover can be opened. In this case, the motor may be rotated in the opposite direction so that the upper cover 12 can be closed when a set signal is inputted into the control section. In this embodiment, the image forming apparatus has been explained in which the upper cover 12 is installed in the upper portion of the process cartridge 15. However, the present invention is not limited to the specific embodiment. In the case of what is called a clam shell type of image forming apparatus, the opening means may be provided to the upper housing instead of the upper cover 12 in this embodiment. Concerning the detection means to detect the opening and closing of the upper cover 12, not only a microswitch but also a conventional switch such as a photoelectric switch and a magnetic switch may be adopted. Two switches are not necessarily provided, but one of them may be provided.

Referring now to FIG. 1 and FIGS. 13-*a*, 13-*b*, the fixing roller release means will be explained.

In this embodiment, the opening and closing motion of the upper cover 12 is utilized for the release of the fixing roller. In this embodiment, a protrusion 43 is provided which is rotated integrally with the upper cover 12 in the position close to the upper cover shaft 39 so that the protrusion 43 can function as a cam. The fixing roller is composed of a press roller 301 and a heating roller 302, and a separation member not illustrated in the drawing and a cleaning member are provided around the heating roller 302 which is rotated clockwise by a drive system not illustrated in the drawing. The press roller 301 can be rotated counterclockwise following the rotation of the heating roller 302, and the a press roller shaft 303 is pivotally supported by a release member 304. One end of the release member 304 is rotatably supported by the apparatus body 10 through a release shaft 305, and the release member 304 is pushed clockwise by a spring 306. Accordingly, as illustrated in FIG. 13-*a*, in an image forming operation, the press roller 301 pushes the heating roller 302, and the heating roller 302 is rotated being heated by a heating means not shown in the drawing, so that a toner image on a transfer sheet can be thermally fixed and the transfer sheet can be conveyed by a paper discharging roller 31.

The aforementioned release mechanism of the fixing roller operates as follows: when the upper cover 12 has been released, the protrusion 43 is rotated counterclockwise; the release member 304 is rotated counterclockwise with a fulcrum of the release shaft 305; and the press roller 301 pivotally supported by the release member 304 releases the press against the heating roller 302. In the manner described above, a gap is made between the press roller 301 and the heating roller 302, so that a jammed paper can be easily removed from the fixing section.

On the contrary, when the fixing roller is pressed, the operation is conducted as follows: when the upper cover 12 has been closed, the protrusion 43 is rotated clockwise; and since the release member 304 is pushed clockwise by the spring 306 with a fulcrum of the release shaft 305, the press roller 301 pushes the heating roller 302. Consequently, the press and release of the fixing roller can be performed by a simple mechanism.

In this embodiment, the press roller 301 is moved in order to release the fixing roller. However, it is possible to release the fixing roller by moving the heating roller 302. In the release mechanism of this embodiment, the release operation is conducted by a cam mounted on the upper cover 12. However, the release operation of the fixing roller 30 may be directly conducted by a motor and car or by a solenoid according to the signal sent from the control section.

Figure 14:
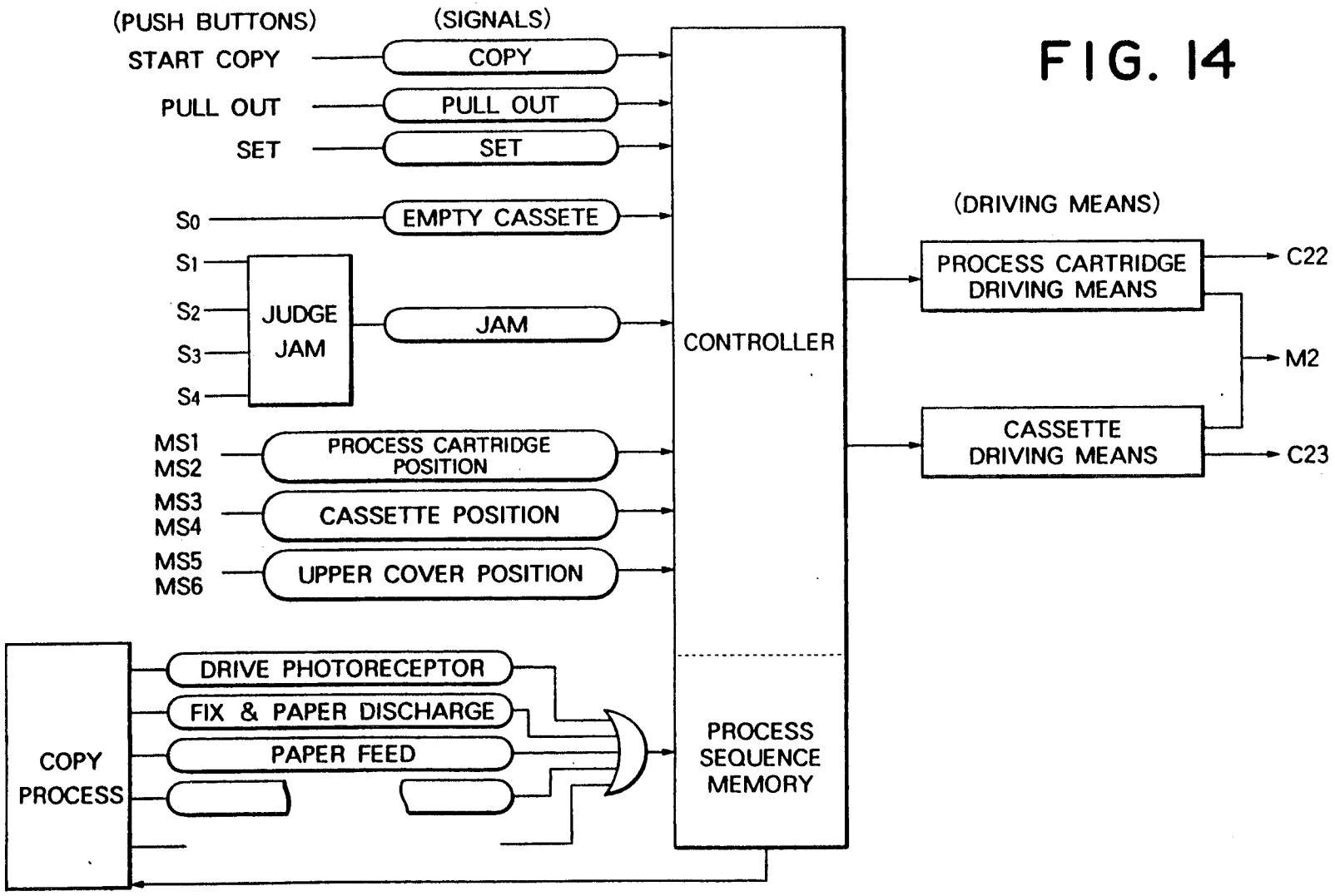
FIG. 14 is a view showing the control system of movement of the process cartridge and cassette.

FIG. 14 shows the aforementioned movement control of the process cartridge 15 and the cassette 16, and shows the opening means of the upper cover 12. The operations are conducted as follows. The jam judging section judges the signals sent from jam detecting sensors $S_1$–$S_4$ in order to judge whether a jam has occurred or not. When it is judged that a jam has occurred, the jam judging section outputs a jam position signal which represents the occurrence and position of the jam, to the control section. Then, the control section stops the operations of the drive sections of the photoreceptor belt drive section, the developing unit drive section, and the fixing unit drive section, and at the same time, the control section displays the occurrence of the jam on the operation panel 11. According to the display on the operation panel, the operator moves the engaging member of the upper cover 12 in order to release the upper cover 12. Microswitch MS6 detects the release of the upper cover 12, and outputs a release signal to the control section. As shown in the table of FIG. 15, the control section outputs a movement signal to the process cartridge moving means and/or the cassette moving means. In other words, the control section outputs a movement signal only to the moving means of mark O in FIG. 15 according to the position where the jam has occurred. In the case where a jam has occurred in S4, only when an image is formed on a plurality of transfer papers, a movement signal is outputted to the cassette moving means. Even if a jam has not occurred, when the upper cover 12 is opened, a release signal is inputted into the control section from microswitch MS6, and the control section outputs movement signals of the process cartridge and the cassette. The process cartridge moving means to which the process cartridge movement signal has been inputted, controls the process cartridge moving drive system in order to move the process cartridge 15 from the first to the second position. When the position detecting signal is obtained that the process cartridge 15 has been moved to the second position, the movement of the process cartridge moving drive system is stopped. The cassette moving means to which the cassette movement signal has been inputted by the control section, moves the cassette 16 from the first to the second position. In other words, as illustrated in FIG. 11 (which shows the state in which both the process cartridge 15 and the cassette 16 are moved), only when the upper cover 12 is opened, the process cartridge 15 and/or the cassette 16 are automatically withdrawn to the second position, and only the portion necessary for jam treatment is withdrawn, and at the same time the press of the fixing roller 30 is released, so that the jammed paper can be easily checked and removed. After the jammed paper has been removed, the upper cover is closed, and then the closing signal of the upper cover 12 is inputted into the control section from microswitch MS5. When the process cartridge moving means or the cassette moving means is located in the second position, the control unit outputs a movement signal in order to move the cartridge or cassette to the first position. In other words, after the jammed paper has been removed, only when the upper cover 12 is closed, the process cartridge 15 and/or the cassette 16 which are located in the second position, are automatically inserted into the apparatus body, so that the labor of an operator can be lessened, and further the process cartridge 15 and the cassette 16 can be set to the most optimum position.

Except for the period of time in which the upper cover is opened, in order to move the process cartridge 15 for replacement, a process cartridge take-out button provided on the operation panel 11 is pressed, and in order to move the cassette for replacement, a cassette take-out button provided on the operation panel is pressed. In other words, when the process cartridge take-out button or the cassette take-out button is pressed, the process cartridge take-out signal or the cassette take-out signal is inputted, and even when a jam signal is not inputted into the control section, under the condition that an image forming process signal such as a photoreceptor drive signal, a fixing and paper discharging drive signal and a paper feed drive signal, is not outputted, a movement signal is outputted to the cartridge moving means or to the cassette moving means so that the process cartridge 15 or the cassette 16 can be moved from the first to the second position. On the contrary, when the process cartridge 15 and the cassette 16 is moved from the second to the first position, a set button on the operation panel is pressed so that the process cartridge 15 and/or the cassette 16 can be moved from the second to the first position. Not only when a jam has occurred but also when it has been detected by empty cassette sensor $S_0$ that there is no transfer paper in the cassette 16, only the cassette 16 can be moved.

In this embodiment, the present invention is applied to the image forming process in which a color toner image is formed on a photoreceptor belt and then the toner image is transferred onto a transfer sheet all at once. However, the present invention may be applied to the image forming process in which a toner image is superimposed on a transfer paper wound around a transfer drum. The present invention can be also applied to a conventional monochrome printer in which a monochrome process is utilized. In the aforementioned embodiment, the present invention is applied to a non-contact developing method. However, the present invention can be also applied to a contact developing method. Concerning the drive system, the present invention is not limited to the specific embodiment. In this embodiment. a protruded member, a guide member, a rack and a pinion are utilized for the process cartridge moving means. However, the present invention is not limited to the specific embodiment. For example, the process cartridge may be set on a tray, and the tray may be moved between the first and the second position.

The essential composition of the present invention can be applied to a transfer drum type of copier (the fourth embodiment). Except for the system of signal generation and control, the mechanical structure is the same as that of the second embodiment shown in FIG. 12, so that the explanation will be omitted.

As explained in the third and fourth embodiment, according to the present invention, when an operator who has checked the occurrence of a jam, opens the upper cover, the process cartridge is automatically withdrawn from the image formation position and the cassette is also withdrawn from the paper feed position. On the other hand, when the process cartridge and paper cassette are inserted into the apparatus body, they can be set to the most optimum position.

As a result, according to the image forming apparatus of the present invention, when the upper cover is opened, the process cartridge and/or the cassette are automatically moved according to the position where a jam has occurred. Consequently, the labor of the operator can be lessened. When a jam has occurred, the process cartridge and cassette are withdrawn to the second position and the upper cover is opened, so that the operator can easily check the position where the jam has occurred. Consequently, a wide work space can be ensured, and the work efficiency of jam treatment can be improved. Further, there is no possibility of damaging the surface of an image carrier when the jammed paper is removed, and it is not necessary for an operator to touch the surface of the image carrier. Furthermore, the process cartridge is mechanically and automatically moved, so that the process cartridge is not vibrated unnecessarily, and when the process cartridge is replaced or moved in order to remove a jammed paper, the developer is scarcely scattered and maintainability can be improved. When image formation is continuously conducted on transfer sheets, in the case where a jam has occurred in a position close to a paper discharging roller, it is not necessary to move two movable portions in order to remove one jammed transfer sheet, so that the jammed paper can be easily and positively removed.

In the case where the present invention is applied to a color printer, the operations of process cartridge insertion, cassette insertion, jam treatment and toner supply can be conducted from the front side of the apparatus, so that the same operability and maintainability as those of a monochrome printer can be realized.

Referring to the drawings, the fifth embodiment of the present invention will be explained as follows. The explanations of the units which are common to the first to fourth embodiment, will be omitted in principle. When necessary, the explanations will be conducted referring to the drawings.

The color printer applied to this embodiment is the same as that shown in FIG. 1. The copying operation, the process cartridge, the cassette, the drive systems and the mechanical structure are all the same as those of the first embodiment in which FIG. 1 to FIG. 8 are referred. The characteristics of this embodiment will be explained referring mainly to FIG. 16 to FIG. 18

Figure 16A:
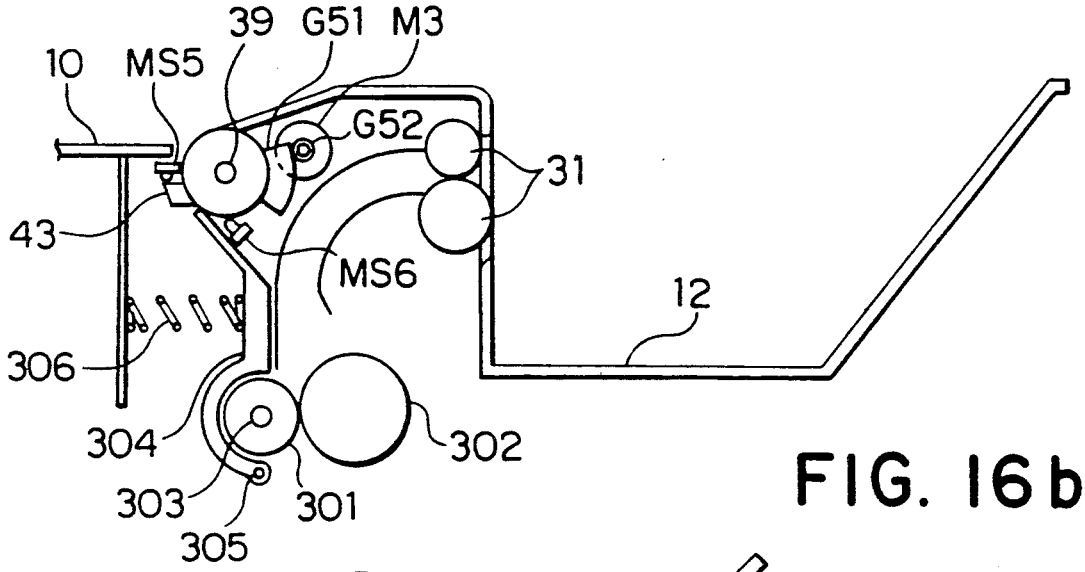
FIG. 16 is a view showing the release mechanism of the upper cover in another embodiment.
Figure 16B:
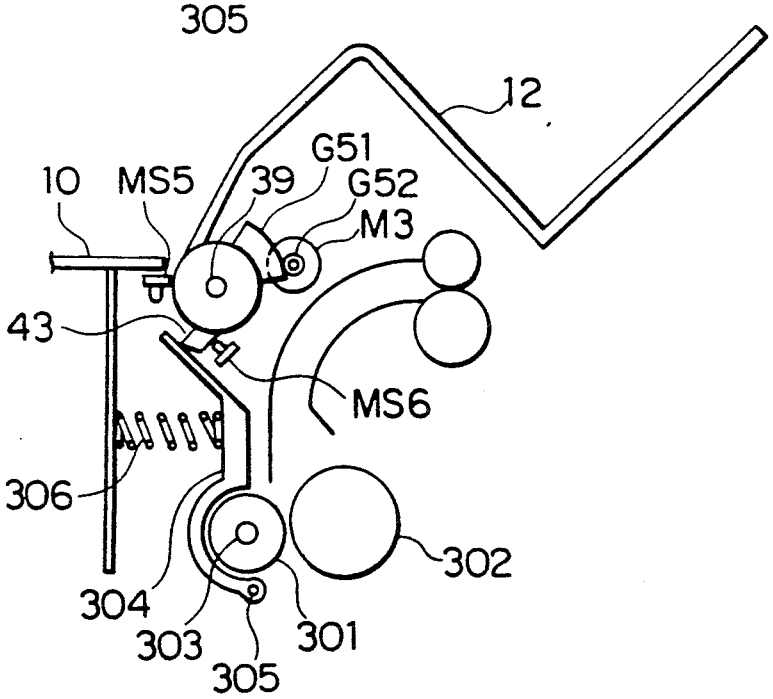

Referring to FIGS. 16-*a* and 16-*b*, the upper cover release means will be explained as follows.

An upper cover 12 is rotatably supported by an upper cover shaft 39. The upper cover shaft 39 is provided with a gear G51 that the upper cover can be opened and closed. Motor M3 which is mounted on an apparatus body 10, is provided with a gear G52 which meshes with gear G51. Further, microswitches MS5 and MS6 are provided which positional detecting sensors to detect the opening and closing of the upper cover 12.

The upper cover 12 is closed during an image forming process, and the upper cover 12 functions as a paper discharging tray on which transferred sheets discharged by a discharging roller 31 are stacked An upper cover opening signal is inputted into the upper cover opening means from a control section which will be explained later. When a signal is inputted into motor M3, motor M3 is rotated clockwise in the drawing, and the rotation is transmitted to gear G51 through gear G52, so that gear G51 is rotated counterclockwise. Consequently, the upper cover 39 is rotated around the upper cover shaft 39 counterclockwise, so that the upper cover can be opened. Microswitch MS6 detects that the upper cover 12 has been opened, and outputs an opening signal to a control section. When the opening signal is inputted into the control section, it stops the rotation of motor M3. In the manner described above, the upper cover 12 is opened as shown in FIG. 16-*b*. Since the upper cover 12 is opened, it is easy to find a jammed paper and to remove it.

On the contrary, when the upper cover 12 is closed, the operator rotates the opened upper cover 12 so that it can be closed. Otherwise, when a closing signal is inputted into motor M3 from the control section which will be explained later, it is rotated counterclockwise, so that the upper cover is rotated clockwise. When microswitch MS3 detects that the upper cover 12 has been closed, the control section stops the rotation of motor M3. In the aforementioned manner, the upper cover 12 is closed (FIG. 16-*a*). The structure of the upper cover opening means is not limited to this embodiment. The upper cover 12 may be opened in such a manner that: the upper cover 12 is pushed by a spring in the opening direction; an engaging member to engage with the upper cover 12; and when an opening signal is inputted, the upper cover 12 is released from the engagement. However, the present invention is not limited to the specific embodiment. In the case of what is called a clam shell type of image forming apparatus, the opening means may be provided to the upper housing instead of the upper cover 12 in this embodiment.

Referring now to FIGS. 16-*a*, 16-*b*, the fixing roller release means will be explained.

In this embodiment, the opening and closing motion of the upper cover 12 is utilized for the release of the fixing roller 30. In this embodiment, a protrusion 43 is provided which is rotated integrally with the upper cover 12 in the position close to the upper cover shaft 39 so that the protrusion 43 can function as a cam. The fixing roller 30 is composed of a press roller 301 and a heating roller 302, and a separation member not illustrated in the drawing and a cleaning member are provided around the heating roller 302 which is rotated clockwise by a drive system not illustrated in the drawing. The press roller 301 can be rotated counterclockwise following the rotation of the heating roller 302, and the a press roller shaft 303 is pivotally supported by a release member 304. One end of the release member 304 is rotatably supported by the apparatus body 10 through a release shaft 305, and the release member 304 is pushed clockwise by a spring 306. Accordingly, as illustrated in FIG. 16-*a*, in an image forming operation, the press roller 301 pushes the heating roller 302, and the heating roller 302 is rotated being heated by a heating means not shown in the drawing, so that a toner image on a transfer sheet can be thermally fixed and the transfer sheet can be conveyed by a paper discharging roller 31.

The aforementioned release mechanism of the fixing roller 30 operates as follows: when the upper cover 12 has been released, the protrusion 43 is rotated counterclockwise; the release member 304 is rotated counterclockwise with a fulcrum of the release shaft 305; and the press roller 301 pivotally supported by the release member 304 releases the press against the heating roller 302. In the manner described above, a gap is made between the press roller 301 and the heating roller 302, so that a jammed paper can be easily removed from the fixing section.

On the contrary, when the fixing roller is pressed, the operation is conducted as follows: when the upper cover 12 has been closed, the protrusion 43 is rotated clockwise; and since the release member 304 is pushed clockwise by the spring 306 with a fulcrum of the release shaft 305, the press roller 301 pushes the heating roller 302. Consequently, the press and release of the fixing roller can be performed by a simple mechanism.

In this embodiment, the press roller 301 is moved in order to release the fixing roller. However, it is possible to release the fixing roller by moving the heating roller 302. In the release mechanism of this embodiment, the release operation is conducted by a cam mounted on the upper cover 12. However, the release operation of the fixing roller 30 may be directly conducted by a motor and cam or by a solenoid according to the signal sent from the control section.

Figure 17:
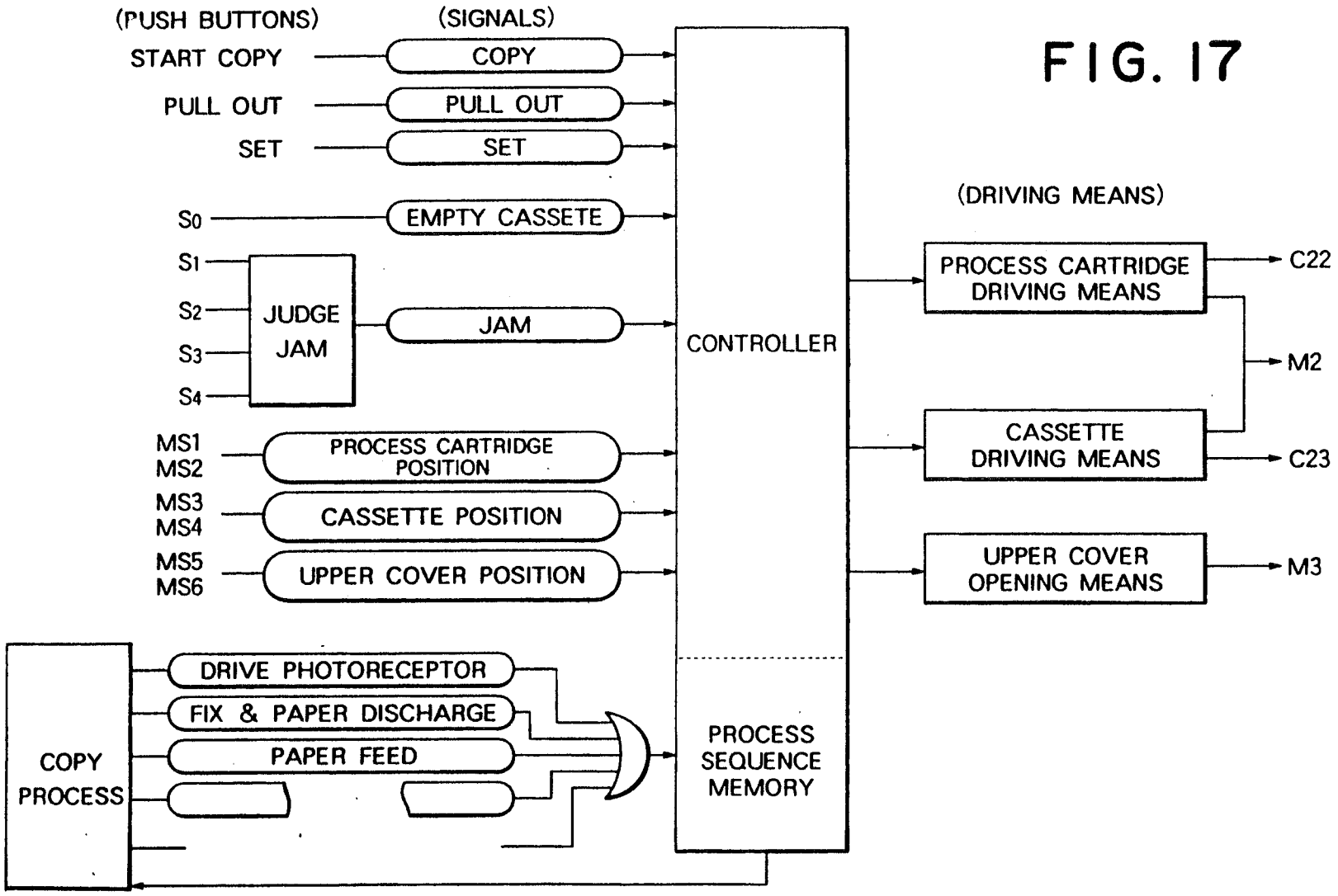
FIG. 17 is a view showing the control system of movement of the process cartridge and the cassette of another embodiment.

FIG. 17 shows the aforementioned movement control of the process cartridge 15 and the cassette 16, and shows the opening means of the upper cover 12. The operations are conducted as follows. The jam judging section judges the signals sent from jam detecting sensors $S_1$–$S_4$ in order to judge whether a jam has occurred or not. When it is judged that a jam has occurred, the jam judging section outputs a jam position signal which represents the occurrence and position of the jam, to the control section. Then, the control section stops the operations of the drive sections of the photoreceptor belt drive section, the developing unit drive section, and the fixing unit drive section, and at the same time, the control section displays the occurrence of the jam on the operation panel 11. Further, according to the position where a jam has occurred, the process cartridge moving means, the cassette moving means and the upper cover opening means are controlled. As illustrated in FIG. 18, a moving signal is outputted into a means which is shown by mark O, in accordance with the position where the jam has occurred. That is, the control unit outputs a movement signal as follows: when a jam has occurred in a position ($S_1$) where transfer papers are supplied, the signal is inputted into the cassette moving means; when a jam has occurred at a timing ($S_2$), the signal is inputted into the process cartridge moving means, the cassette moving means and the upper cover opening means; when a jam has occurred in a position ($S_3$) of transfer, the signal is inputted into the process cartridge 15 and the upper cover 12; and when a jam has occurred in a position ($S_4$) of paper discharge, the signal is inputted into the upper cover opening means. The process cartridge moving means into which the process cartridge moving signal is inputted from the control section, controls the process cartridge moving drive system in order to move the process cartridge 15 from the first to the second position. When the positional signal that the process cartridge has moved to the second position, is obtained, the process cartridge moving drive system is stopped. The cassette moving means into which a cassette movement signal is inputted from the control section, moves the cassette 16 from the first to the second position. The upper cover opening means into which an opening signal is inputted, opens the upper cover. As illustrated in FIG. 11 (which is a view showing that both the process cartridge 15 and the cassette 16 are moved to the second position, and the upper cover 12 is opened), when a jam has occurred, the units necessary for jam treatment are automatically withdrawn and released without any operation by an operator, so that the operator can easily check the position where the jam has occurred and positively remove the jammed paper. Even when the process cartridge 15 located in the second position is a little inserted in the direction of the first position after a jam has been treated, or even when the cassette 16 located in the second position is a little inserted, or even when the upper cover which is opened, is rotated in the direction of closing, the control section controls the process cartridge moving means, the cassette moving means, and the upper cover opening means. Only when the process cartridge 15 or the cassette 16 is located in the second position, it is moved to the first position (when it is located in the first position, it is left as it is), and only when the upper cover 12 is opened, it is closed (when the upper cover 12 is closed, it is left as it is). Accordingly, when a simple operation is performed by the operator, the process cartridge 15 and the cassette 16 can be set to the first position and the upper cover 12 can be closed, so that the labor of the operator can be greatly lessened, and further the process cartridge 15 and the cassette 16 can be set to the most optimum position. In the case of replacement, the process cartridge 15 or the cassette 16 can be moved by pressing a take-out button provided on the operation panel 11. That is, when the take-out button on the operation panel is pressed, the take-out signal is inputted into the control section. When a print signal is not outputted from a print button on the operation panel, and when an image forming process signal such as a photoreceptor belt drive signal, a fixing and paper discharging drive signal, and a paper feed drive signal, is not outputted, a process cartridge movement signal, a cassette movement signal and an upper cover opening signal are respectively outputted into the process cartridge moving means, the cassette moving means, and the upper cover opening means, even if a jam signal is not inputted into the control section. Therefore, as described above, the process cartridge 15 and the cassette 16 can be moved from the first to the second position, and at the same time, the upper cover 12 can be opened. On the contrary, when the process cartridge 15 and the cassette 16 are moved from the second to the first position and the upper cover 12 is closed, a set button provided on the operation panel 11 is pressed. Then, the control section outputs a movement signal to the moving means so that the process cartridge 15 or the cassette 16 located in the second position can be moved to the first position, and so that the upper cover 12 which has been opened, can be closed. In other words, after the set bottom on the operation panel has been pressed, the process cartridge 15 and the cassette 16 are located in the first position, and the upper cover 12 is closed, so that the image forming apparatus can be set to the condition in which image formation can be performed. The take-out button and set button on the operation panel may be provided in such a manner that: the process cartridge 15, the cassette 16 and the upper cover 12 can be moved all at once when a single button is pressed. Otherwise, the take-out button and set button may be independently provided to move the process cartridge and the cassette, and to open and close the upper cover. When it is judged by empty cassette sensor $S_0$ that all the transfer sheets in the cassette have been consumed, only the cassette 16 can be moved.

In this embodiment, the present invention is applied to the image forming method in which a color toner image is formed on a photoreceptor belt, and the color toner image is transferred onto a transfer sheet by one transfer operation. However, the present invention may be applied to the image forming method in which a toner image is superimposed on a transfer sheet wound around a transfer drum. Further, the present invention can be applied to a conventional monochrome printer in which a monochrome process is utilized. In the aforementioned embodiment, a non-contact developing method is used. However, the present invention is nor limited to the specific embodiment, and the present invention can be also applied to a contact developing method. The drive system of the present invention is not limited to the specific embodiment. In this embodiment, a protruded member, guide member, rack and pinion are used to move the process cartridge. However, the present invention is not limited to the specific embodiments. For example, the process cartridge may be set on a tray, and the tray may be moved between the first and second position.

FIG. 12 shows a transfer drum type of image forming apparatus of the sixth embodiment of the present invention. Although the structure of a process cartridge 15 is approximately the same as that of the aforementioned embodiment, a toner hopper 35*a* is integrally provided in the process cartridge 15 in this embodiment In the transfer drum type of image forming apparatus, a transfer drum 50 is contacted with the transfer portion of the photoreceptor belt 17, and the transfer drum 50 is rotated synchronously with the photoreceptor belt 17. A transfer sheet is wound around the transfer drum 50, and a toner image of each color formed on a photoreceptor belt 17 is transferred onto the aforementioned transfer sheet. After the toner image of each color is superimposed on the transfer sheet, the transfer sheet is separated from the transfer drum 50 and discharged to the upper portion of a fixing unit body 10.

A charging unit 501 which electrostatically attracts the transfer sheet and a winding member 502 which mechanically wounds the transfer sheet around the transfer drum 50 are provided in the peripheral portion of the transfer drum 50. A roller is mounted on the tip of the winding member 502, and the roller is contacted with the transfer drum 50 only when the leading edge of the transfer sheet is wound around the transfer drum 50. A gripper 503 is provided on the circumferential surface of the transfer drum 50 in order to hold the leading edge of the transfer sheet which has been conveyed synchronously. The transfer unit 504 electrostatically transfers the toner image formed on the photoreceptor belt 17 onto the transfer sheet. A discharging electrode 505 and a separating claw 506 separate the transfer sheet from the transfer drum 50 after the toner image has been transferred onto the transfer sheet. A cleaner 507 which can be contacted with or separated from the transfer drum 50, removes the residual toner on the transfer drum 50.

A yellow toner image is transferred onto a transfer sheet in such a manner that: the transfer sheet which has been fed from the cassette 16 is synchronously conveyed to the transfer drum 50 which has been charged by the charging unit 501; the transfer sheet is wound around the transfer drum 50 by the winding member 502; the leading edge of the transfer sheet is held by the gripper 503; the transfer sheet is rotated together with the transfer section of the photoreceptor belt 17; and the yellow toner image formed on the photoreceptor belt 17 is transferred onto the transfer sheet by the transfer unit 504. After the first transfer operation has been completed, the transfer drum 50 is continuously rotated and cleaned by the cleaner 507, and then the next toner image is transferred. A magenta toner image is transferred in the second rotation of the transfer drum 50, a cyan toner image is transferred in the third rotation, and a black toner image is transferred in the fourth rotation in such a manner that each toner image is superimposed. After 4 toner images has been transferred, the transfer sheet is discharged by the discharging electrode 505, and the leading edge of the transfer sheet is released by the separating claw 506, and then the transfer sheet is conveyed to the fixing roller 30.

In the image forming apparatus of this embodiment, the transfer drum 50 is provided on the apparatus body 10 side, so that it is not integrated in the process cartridge 15. Accordingly, the process cartridge 15 is moved in the same manner as the aforementioned embodiment.

As explained above, in the embodiment of the present invention, when a jam has occurred, the process cartridge is automatically withdrawn from the image forming position, and the cassette is also automatically withdrawn form the paper feed position, and at the same time the upper cover is opened. On the other hand, when the process cartridge and cassette are inserted into the apparatus body, they can be automatically set to the most optimum position and the upper cover is closed so that image formation can become possible.

As described above, in the image forming apparatus of this embodiment, when a jam has occurred, the process cartridge and cassette are automatically moved, and at the same time the upper cover is opened, so that the labor of an operator can be lessened. When a jam has occurred, the process cartridge and cassette are withdrawn to the second position and the upper cover is opened, so that the operator can easily check the position where the jam has occurred. Consequently, a wide work space can be ensured, and the work efficiency of jam treatment can be improved. Further, there is no possibility of damaging the surface of an image carrier when the jammed paper is removed, and it is not necessary for an operator to touch the surface of the image carrier. Furthermore, the process cartridge is mechanically moved, so that the process cartridge is not vibrated unnecessarily, and when the process cartridge is replaced or moved in order to remove a jammed paper, the developer is scarcely scattered and maintainability can be improved.

Even in the case of a color printer, all of the operations such as cassette installation, jam treatment, and toner supply, can be conducted from the front side of the apparatus, so that high maintainability can be realized in the same manner as a monochrome printer.

Referring to the attached drawings, the sixth embodiment of the present invention will be explained as follows.

Figure 19:
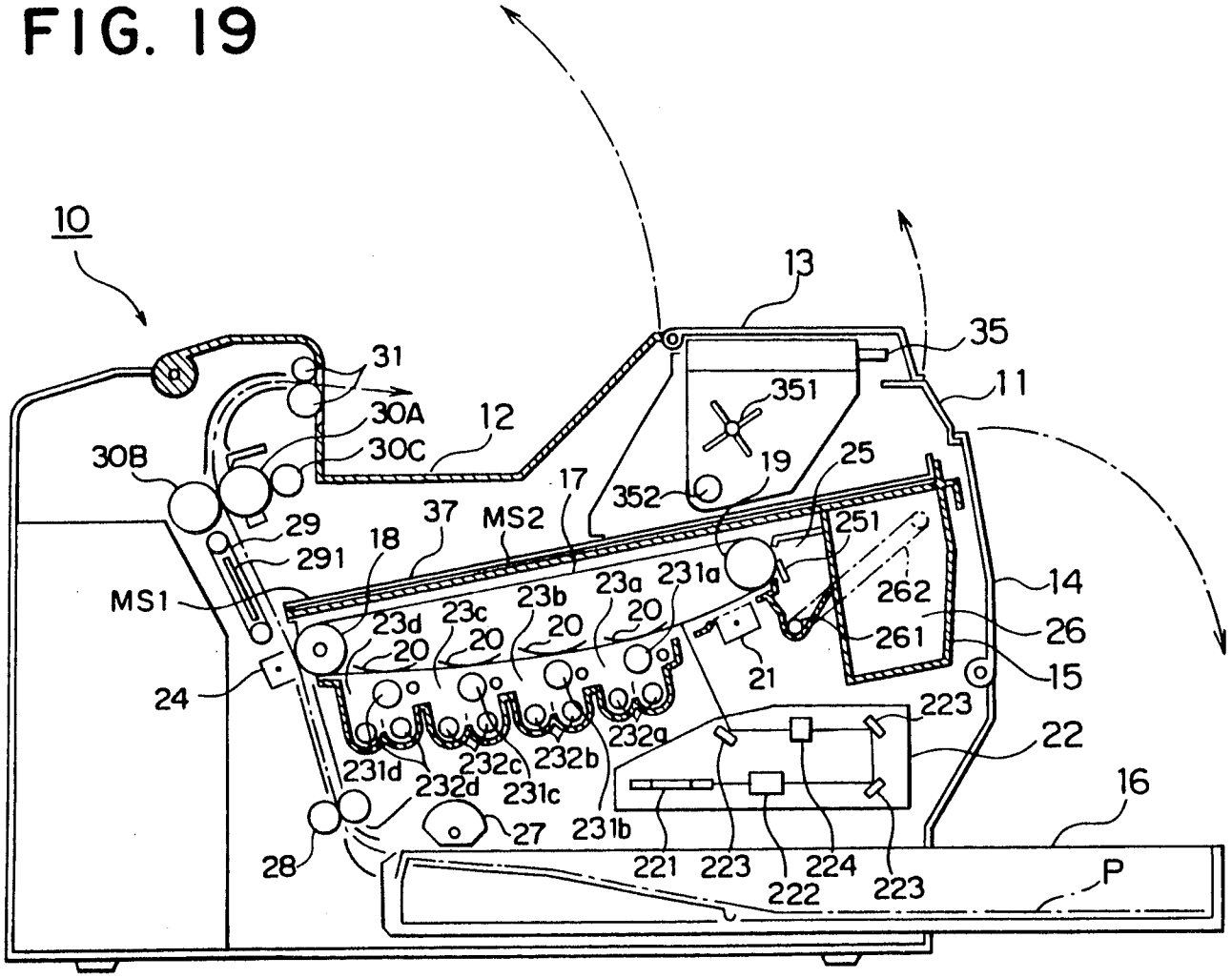
FIG. 19 to FIG. 31 are views which show a further embodiment.
Figure 20:
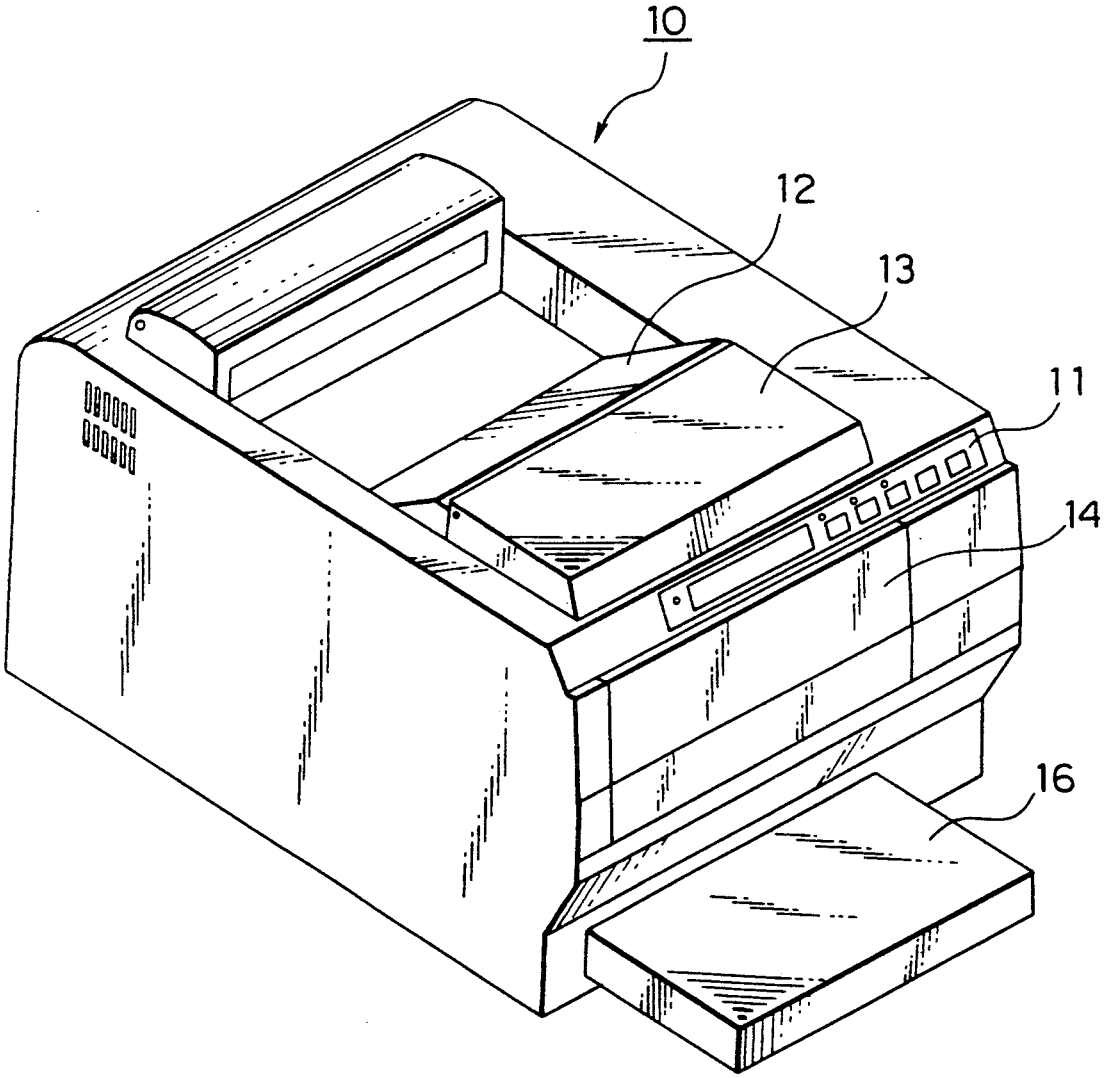

FIG. 19 is a left side sectional view of a color printer of the sixth embodiment to which the present invention is applied. FIG. 20 is a perspective view of the color printer. The front portion of an apparatus body 10 is covered with an operation panel 11, an upper cover (an upper lid) 12 which can be freely opened and closed, a toner supply cover 13, and a front cover 14. A detachable process cartridge 15 and paper supply cassette 16 are provided inside the apparatus body 10 FIG. 19 and FIG. 20 correspond to FIG. 1 and FIG. 2 showing the first embodiment. The structure of the copier of the sixth embodiment is approximately the same as that of the first embodiment, so that the explanation of the copier will be omitted.

Figure 21:
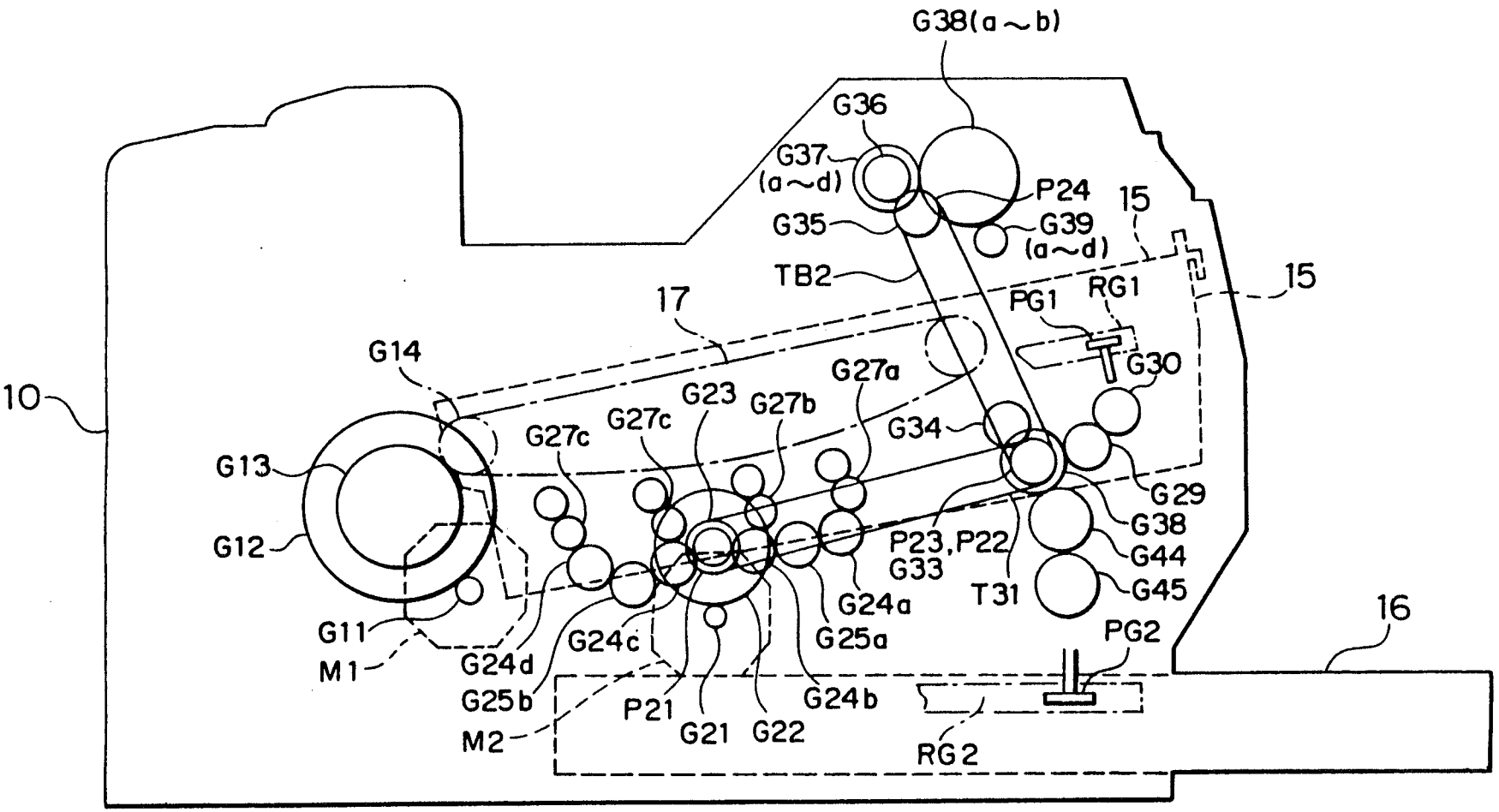
Figure 22:
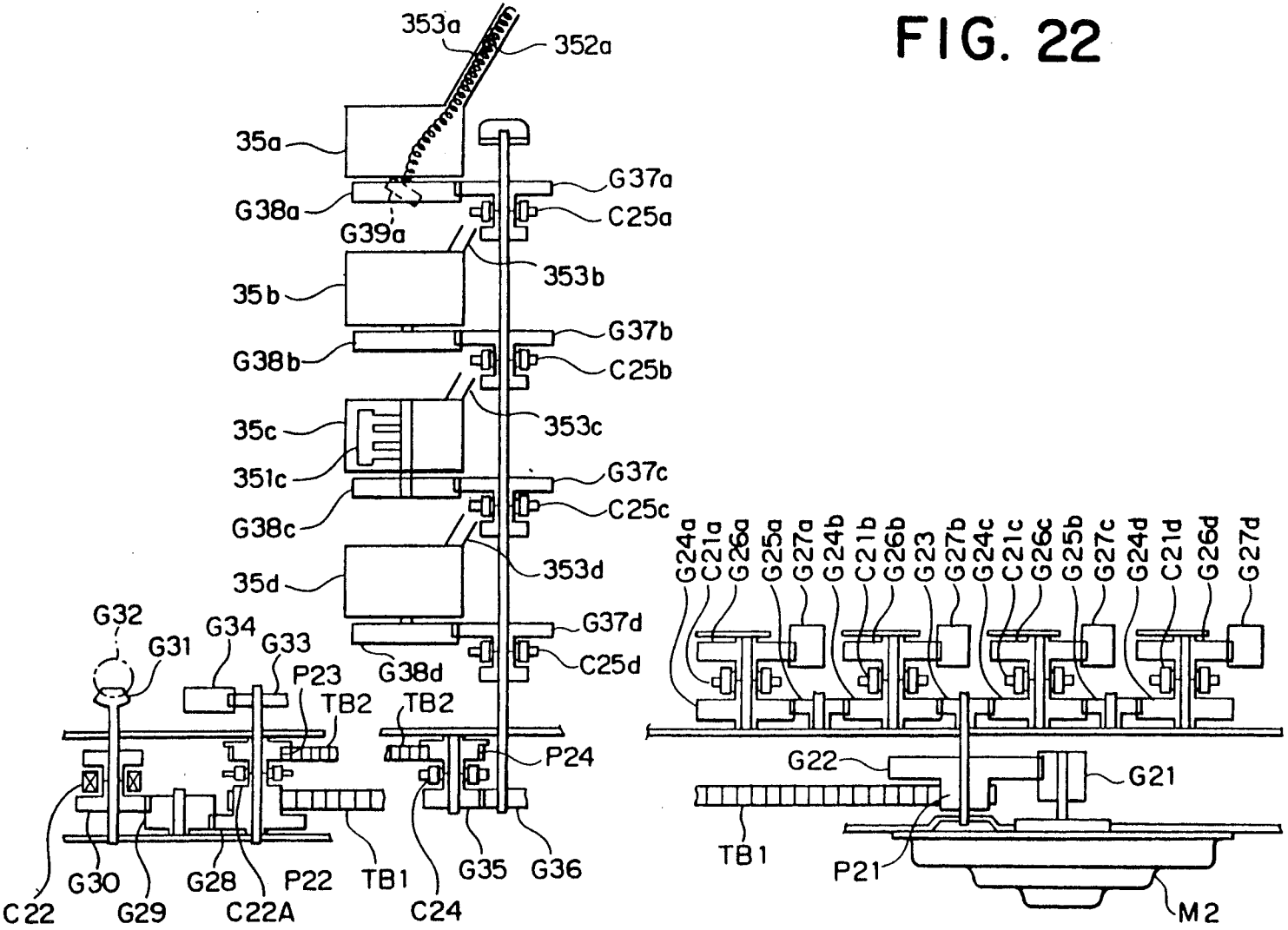
Figure 23:
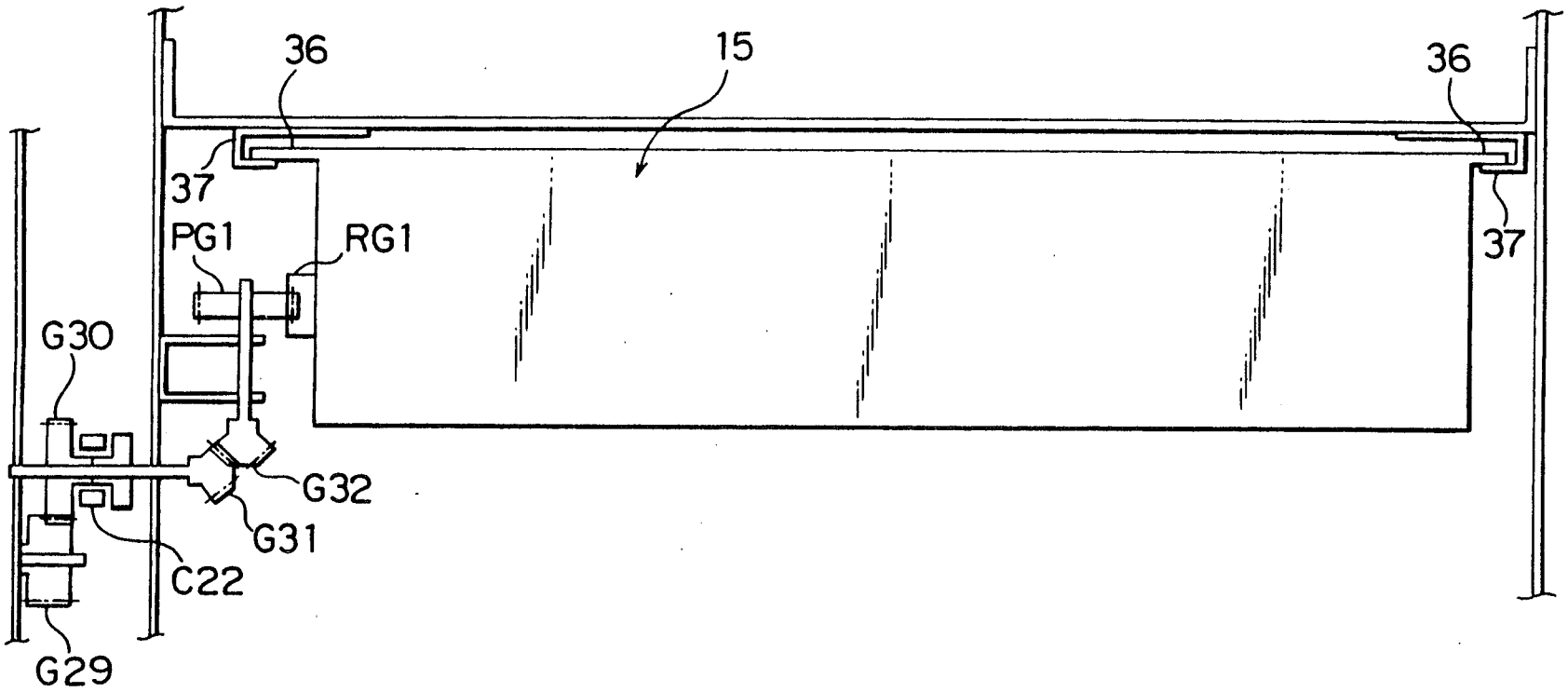

Referring now to FIG. 21–FIG. 23, the drive system of a process cartridge 15 will be explained as follows.

FIG. 21 is a left side view showing the drive system of the process cartridge 15 and the drive system of process cartridge movement. In this embodiment, the drive system of the process cartridge 15 and the drive system of process cartridge movement are respectively driven by two motors M1, M2.

The drive system of a photoreceptor belt 17 is driven by motor M1. Gear G12 is disposed in such a manner that it meshes with gear G11 mounted on the shaft of motor M1. When a process cartridge 15 is located in a image forming position, gear G14 provided to the same shaft as that of a roller 18, meshes with gear G13 which is integrated with gear G12. The rotation of motor M1 is transmitted to gear G14 through gears G11, G12, and G13 so that the rotating speed can be appropriately adjusted. Accordingly, the roller 18 is rotated clockwise in the drawing integrally with gear G14, so that the photoreceptor belt 17 is moved.

The drive system of the developing units **23*a*–23*d*, that of the used toner screw 261, and that of the toner hopper 35** will be explained as follows.

In this drive system, motor M2 is utilized. The rotation of motor M2 is transmitted to gear G22 through gear G21 provided to the shaft of motor M2. The rotation is further transmitted to gear G23 which is integrally provided to the same shaft as that of gear G22 so that the drive system of the developing units **23*a*–23*d*** can be driven, and the process cartridge and the paper feed cassette can be moved, and the waste toner recovery unit can be driven.

The drive system of the developing units **23*a*–23*d*** will be explained as follows.

The rotation of motor M2 is transmitted to gears **G24*d*, G24*c* through gears G21, G22, G23, and further the rotation is transmitted to gears G24*a*, G24*b* through gears G25*a*, G25*b*. When necessary, a clutch is connected so that the rotation can be transmitted to developing unit drive gears G27*a*–G27*d*. The rotation transmitted to developing unit drive gears G27*a*–G27*d* is transmitted to developing sleeves 231*a*–231*d* and stirring screws 232*a*–232*d* through a gear provided in the process cartridge 15 so that the developing units 23*a*–23*d*** can be driven.

Next, the movement means of the process cartridge will be explained as follows.

The rotation of motor M2 transmitted to gear G22 is transmitted to pulley P22 through rotating pulley P21 and timing belt TB1, and the rotation is also transmitted to gear G29 which meshes with gear G28 rotating integrally with pulley P22. The rotation transmitted to gear G29 is further transmitted to gear G30 which meshes with gear G29. When necessary, the rotation is transmitted to gear G31 through electromagnetic clutch C22 Gear G31 and gear G32 are bevel gears, and the rotation transmitted to gear G31 is transmitted to pinion PG1 (Refer to FIG. 5.). The aforementioned pinion PG1 can mesh with rack RG1 which is provided on the side of the process cartridge 15, and the process cartridge 15 is laterally moved in FIG. 19 when pinion PG1 is rotated and rack RG2 is slid.

Next, the drive system of toner recovery will be explained as follows.

The rotation of motor M2 transmitted to pulley P22 is transmitted to pulley P23 through an open type of spring clutch. Since gear G33 rotating integrally with pulley P23 meshes with used toner screw drive gear G34 provided on the side of the process cartridge 15, the torque transmitted to pulley P23 drives the used toner screw 261. The used toner screw 261 conveys the residual toner, which has been removed from the photoreceptor belt 17 by the cleaning means 25, to the toner recovery box 26 through the toner recovery pipe 262 inside which a spiral screw is provided.

Next, the drive system of the toner hoppers 35*a*–35*d* will be explained as follows.

The torque transmitted to pulley P23 from motor M2 is transmitted to pulley P24 through timing belt TB2, so that the torque is transmitted to gear G35 which is mounted on the same shaft as pulley P24, and further transmitted to gear G36 which meshes with gear G35. Gears G37*a*–G37*d* which are arranged on the same shaft as gear G36, and which are provided with a spring clutch, mesh with gears G38*a*–G38*d* provided to the toner hoppers 35*a*–35*d*.

Then, toner hopper stirring members 351*a*–351*d* provided on the same shaft as that of gears G38*a*–G38*d* are rotated so that the toner in the toner hoppers 35*a*–35*d* can be stirred. At the same time, toner screws 352*a*–352*d* provided on the same shaft as that of gears G39*a*–G39*d* which mesh with gears G38*a*–G38*d*, are rotated so that the toner for supply use can be conveyed to the developing units 23*a*–23*d* in the process cartridge 15. The toner hoppers 35*a*–35*d* are driven corresponding to the drive of the aforementioned developing units 23*a*–23*d*. In other words, only a toner hopper containing a toner, the color of which is the same as that of an image being formed, is driven.

In this embodiment, the photoreceptor belt 17 is driven by motor M1, and the developing units 23*a*–23*d*, the used toner screw 261, the toner hopper 35 and the process cartridge moving means are driven by motor M2. However, the aforementioned units may be driven by one motor The process cartridge moving means may be moved by an exclusive motor.

On the side of the process cartridge 15 are provided a protruded member 36 and rack gear RG1 which are used to move the process cartridge 15. In the process cartridge 15 are provided gear G14 to drive the photoreceptor belt 17, gear G27*a*–G27*d* to drive the developing units, and gear G34 to drive the used toner screw.

On the other hand, in the process cartridge holding chamber in the apparatus body 10 are provided a guide member 37 which is engaged with the protruded member 36 of the process cartridge 15 so that the process cartridge 15 can be suspended, gear G14, gear G13 corresponding to developing unit drive gears G27*a*–G27*d* and used toner screw drive gear G34, gear G26*a*–G26*d*, and gear G33. Further, pinion gear PG1 is provided in such a manner that it can mesh with rack gear RG1 provided in the process cartridge 15. The aforementioned guide member 37 is provided with the first and second microswitch MS1, MS2. These first and second microswitch MS1, MS2 are used for a means to detect the position of the process cartridge 15. The first and second microswitch MS1, MS2 detect the first and second position and output the positional signal to the control unit, wherein the first position is defined as the position in which gear G14, developing unit drive gears G27*a*–G27*d*, and used toner screw drive gear G34 which are provided in the process cartridge 15 mesh with gear G13, gear G26*a*–G26*d*, and gear G33 so that images can be formed, and wherein the second position is defined as the position which is apart from the first position in the direction opposite to cassette insertion. It is preferable to determine the second position in such a manner that the gravity center of the cartridge 15 is not located outside the apparatus 10. The reason why is as follows: when the gravity center of the process cartridge 15 is located outside the apparatus, the mesh of rack gear RG1 and pinion gear PG1 is deteriorated, so that it is difficult to move the process cartridge smoothly.

The position detecting sensor used to detect the first and second position is not limited to the microswitch. Various sensors such as a photoconductive switch and a magnetic switch may be used. The first microswitch MS1 and the second microswitch MS2 are not necessarily provided to the guide member 37. They may be provided to the apparatus body 10 as far as they can detect the first and second position.

Referring to FIG. 24-*a* to FIG. 24-*c* showing the movement of the process cartridge 15, the movement will be explained as follows.

First, a case in which the process cartridge 15 is taken out from the apparatus 10 will be explained. As shown in FIG. 24-*a*, the process cartridge 15 is in the first position so that the distance between the drive roller 18 and the transfer unit 24 is maintained to be a predetermined value (in the case of a transfer drum, appropriate contact pressure is maintained). Drive gear G14, gears G27*a*–G27*d* to drive developing units, and gear G34 to drive the used toner screw, which are provided to the process cartridge 15, mesh with gear G13, gears G26*a*–G26*d*, and gear G33, which are provided to the apparatus body 10, so that the apparatus is in the most optimum state for image formation. Rack RG1 meshes with pinion PG1.

When a take-out button on the operation panel 11 is pressed, a take-out signal is inputted into the control section. In the case where an image formation process signal such as a photoreceptor belt drive signal, a fixing unit drive signal, a paper discharge drive signal and a paper feed drive signal, is not outputted, the control section moves the process cartridge 15 in the direction of the second position along the guide member 37 in such a manner that: the control section sends a signal to motor M2 and electromagnetic clutch C22 which are the drive section of the process cartridge moving means, so that pinion PG1 can be rotated in order to move the process cartridge 15 from the first to the second position and the process cartridge 15 is moved along the guide member 37 in the direction of the second position. (Refer to FIG. 24-*b*.)

Figures 24A, 24B, 24C:
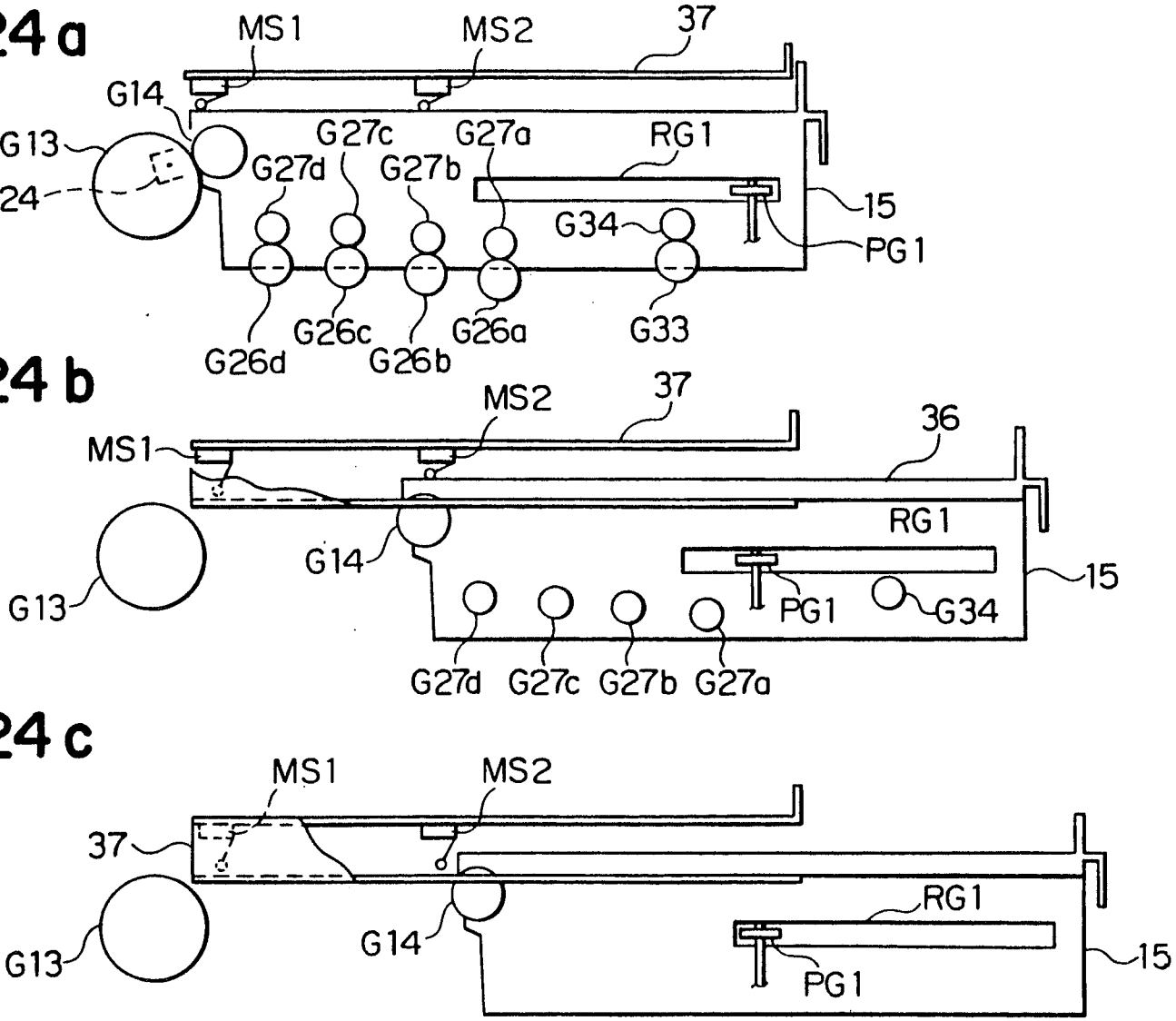

When the process cartridge 15 is moved as shown in FIG. 24*c*, the second microswitch MS2 detects that the process cartridge 15 has moved to the second position, and the detection signal is sent to the control section. When the signal is inputted into the control section, the control section releases electromagnetic clutch C22 and stops the rotation of motor M2.

That is, the process cartridge 15 withdraws from the first position to the second position and stops at the second position while rack RG1 meshes with pinion PG1. Consequently, when a jammed paper is removed, a wide working space can be obtained, and the process cartridge can be easily taken out of the apparatus.

The process cartridge 15 is inserted into the apparatus body 10 in such a manner that: the protruded portion 36 of the process cartridge 15 is slid along the guide member 37 provided in the process cartridge holding chamber while rack RG1 meshes with pinion PG1; and the process cartridge 15 is inserted until it comes to the second position. (Refer to FIG. 24-*c*.)

In order to move the process cartridge 15 from the aforementioned position to the first position in which image formation is possible, the process cartridge 15 located in the second position is further inserted into the apparatus, or a setting button on the operation panel 11 is pressed so that a setting signal can be inputted into the control section. When the setting signal is inputted into the control section, the control section sends a signal to motor M2 and electromagnetic clutch C22, and pinion P1 is rotated in order to move the process cartridge 15 from the second position to the first position so that the process cartridge 15 is moved along the guide member 37 in the direction of the first position (FIG. 24-*b*).

When the process cartridge 15 is moved, the first microswitch MS1 detects that the process cartridge 15 has moved to the first position as illustrated in FIG. 24-*a*, and the signal is sent to the control section from the microswitch MS1. When the signal is inputted into the control section, the control section releases electromagnetic clutch C22 and stops the rotation of motor M2. Namely, the process cartridge 15 stops at the first position, and drive gear G14, gears G27*a*–G27*d* to drive the developing units, and gear G37 to drive the used toner screw gear, which are provided to the process cartridge 15, mesh with gear G13, gears G26*a*–G26*d*, and gear G33, which are provided in the apparatus body 10, so that image formation becomes possible. At this time, toner supply ports 38*a*–38*d* of the developing units 23*a*–23*d* provided in the process cartridge 15, are automatically connected with toner conveyance pipes 353*a*–353*d* of the toner hoppers 35*a*–35*d* so that toner can be supplied to the developing unit. Consequently, after a jammed paper has been removed from the process cartridge 15, or the process cartridge 15 has been replaced for maintenance, the process cartridge 15 can be automatically inserted in the apparatus by a simple operation, so that the labor of the operator can be remarkably lessened and the process cartridge 15 can be positively set to the right image forming position.

Figure 25A:
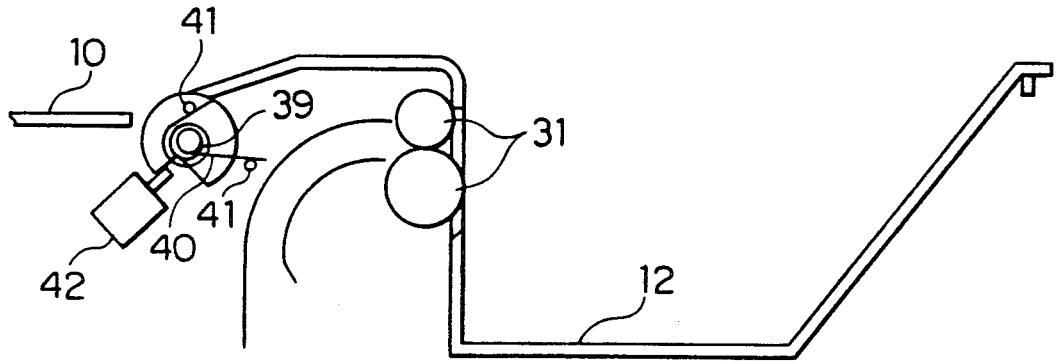
Figure 25B:
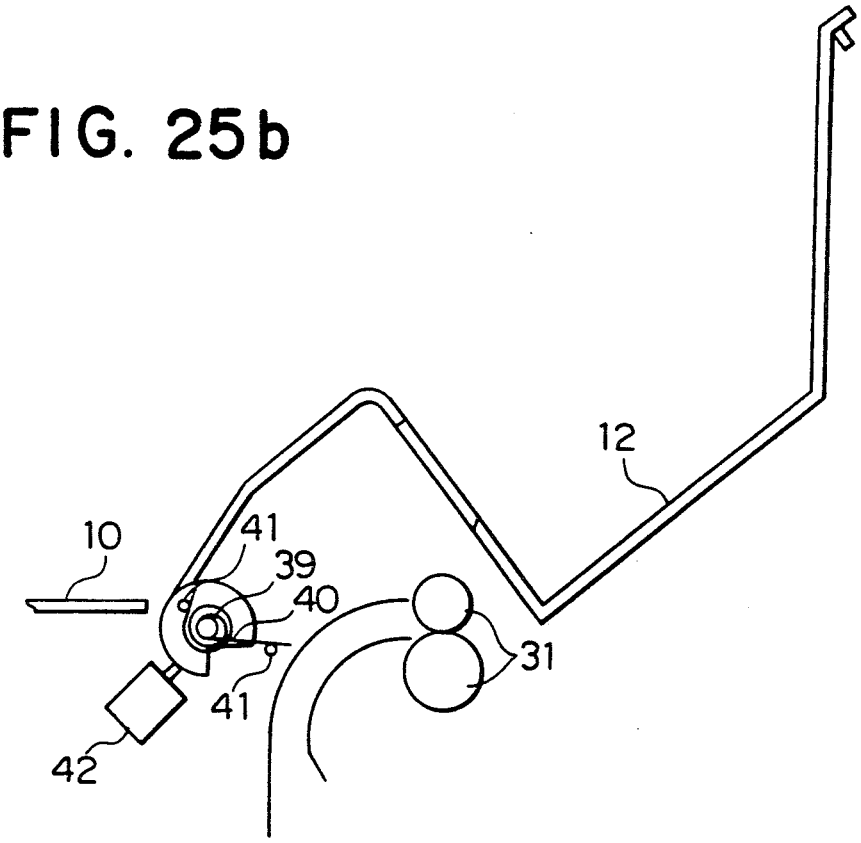

Referring now to FIGS. 25-*a*, 25-*b*, the upper cover opening means will be explained as follows. The upper cover 12 is pivotally supported by an upper cover shaft 39. The upper cover 12 is pivotally supported by the upper cover shaft 39. The upper cover 12 is pushed so that it can be opened, that is, the upper cover 12 is pushed counterclockwise in the drawing by a helical spring 40 wound around an upper cover shaft 39 and pins 41, one of the pins is provided to the upper cover. A solenoid 42 is provided in such a manner that the upper cover 12 can be locked by the solenoid 42 when the upper cover 12 is closed.

Since the aforementioned upper cover release means is provided, the upper cover 12 is closed when image formation is being conducted. The upper cover 12 is also used for a discharge tray on which transfer sheets are stacked (FIG. 25-*a*). In the case where a jammed transfer sheet is taken care of, when a take-out button on the operation panel 11 is pressed and an image formation process signal is not outputted, the control section outputs a moving signal to the process cartridge moving means in order to move the process cartridge 15, and at the same time, outputs a release signal to the solenoid 42 which is the upper cover release means. When the release signal has been inputted into the solenoid 42, the shaft of the solenoid 42 is moved backward, in other words, the lock of the upper cover 12 is released. Then, the upper cover 12 which has been pushed by the spring, is opened a little by the spring force (FIG. 25-*b*), and then the upper cover 12 is fully opened by an manual operation. Since the upper cover 12 is opened in the manner described above, the jammed transfer sheet can be easily found and taken out.

It should be understood that the upper cover release means is not limited to this embodiment. The upper cover shaft 39 may be provided with a gear, and a motor to mesh with the gear may be provided so that the motor can be rotated by a release signal sent from the control section in order to open the upper cover 12. In this case, the motor may be rotated in the reverse direction so that the upper cover can be closed when a set signal is inputted into the control section.

Figure 26A:
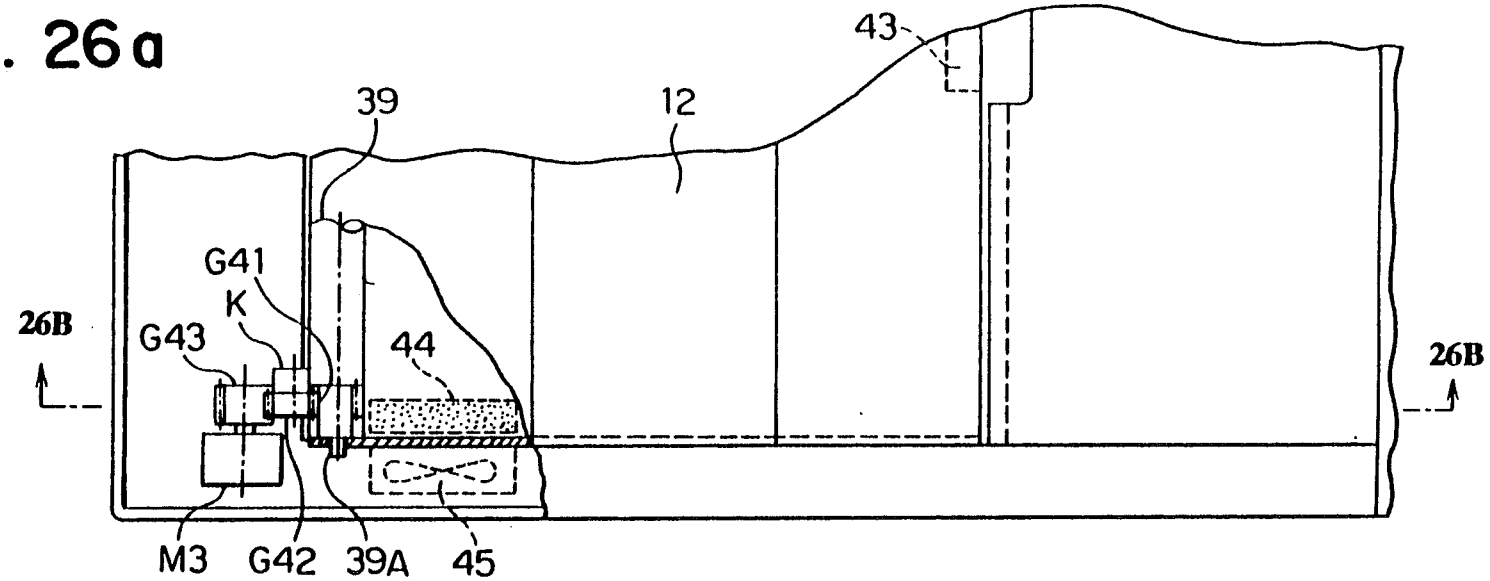
Figure 26B:
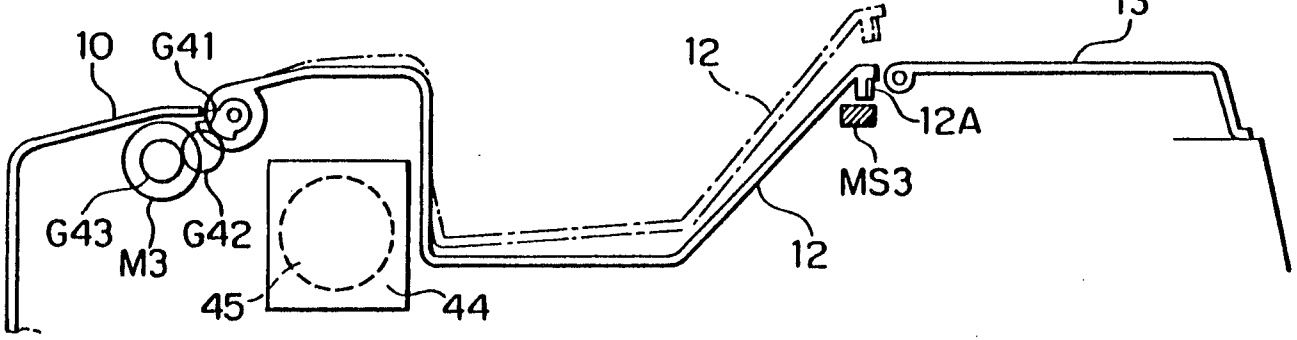

FIGS. 26-*a*, 26-*b* show another embodiment of the opening and closing mechanism of the upper cover 12 to which the present invention is applied. FIG. 26-*a* is a partially plan view, and FIG. 26-*b* is a sectional view taken on line 26 B—26 B FIG. 26-*a*.

One end of the aforementioned upper cover 12 is pivotally supported by an upper cover shaft 39, and one of the upper cover shaft 39 is provided with gear G41. Numeral 39A are hinge shafts which are protruded from both ends of the aforementioned upper cover shaft 39, and the hinge shafts 39A are engaged with the bearing portions of the apparatus body so that the upper cover 12 can be freely opened and closed. The aforementioned gear G41 meshes with gear G43 which is fixed to the drive shaft of DC motor M3 used for opening the upper cover, through intermediate gear G42. The aforementioned gear G41 is a sector gear made in such a manner that a portion of a gear is cut out. One way clutch K is built in the aforementioned intermediate gear G42.

When motor M3 is energized, the torque is transmitted to the upper cover shaft 39 through gears G43, G42, G41, so that the upper cover 12 integrally provided with the upper cover shaft 39 can be rotated counterclockwise. When intermediate gear G42 is rotated by a predetermined angle, gear G42 faces the cut-out portion of sector gear G41. Therefore, although motor M3 is being rotated, sector gear G41 is stopped and the opening motion of the upper cover 12 is stopped when the tip of the upper cover 12 departs a little from the upper opening of the apparatus body 10. After that, the upper cover 12 is opened manually by an operator. At this time, motor M3 is stopped, and intermediate gear G42 which meshes with drive gear G43 of motor M3, faces the cut-out portion of sector gear G41, so that the upper cover 12 can be easily opened by the operator.

When a remarkable color label 12A is put or a remarkable color is painted on the inside of the tip of the aforementioned upper cover 12, it can be easily checked by the operator whether the upper cover 12 is opened or not. Accordingly, a failure in the upper cover closing operation can be checked immediately.

A lock sensor such as a microswitch MS3 is provided in a position on the lower side of the tip of the upper cover 12 in such a manner that microswitch MS3 is engaged with a lower protrusion of the aforementioned upper cover 12 in order to detect the closing motion of the upper cover 12.

Further, a hinge is provided in the tip of the aforementioned upper cover 12 so that a handle 43 which is used when the upper cover is manually opened and closed, can be oscillated being pushed by a spring. A lock claw of the handle 43 is engaged with a lock pin mounted on the apparatus body 10. When the operator opens the upper cover 12 manually, he holds the handle 43 and releases the engagement with the lock pin, and then rotates the upper cover 12 upward. When the upper cover 12 is closed, the tip of the upper cover is pressed toward the apparatus body 10, and the lock claw of the handle 43 is engaged with the lock pin and the lock condition is detected by microswitch MS3.

An ozone filter 44 and an exhaust fan 45 are provided on the side of the apparatus body 10 close to one end of the aforementioned upper cover shaft 39. When the upper cover 12 is opened by a motor operation, a motor and manual operation, or a manual operation, the aforementioned ozone filter 44 is exposed, so that it can be easily replaced.

The aforementioned control of process cartridge movement and upper cover opening is shown in FIGS. 19 and 20. The control is conducted as follows. When the take-out button on the operation panel 11 is pressed, a take-out signal is inputted into the control section. At this time, in the case where a photoreceptor belt drive signal, a fixing and discharging signal, and a paper feed drive signal are not outputted, the control unit outputs an opening signal to the upper cover opening means, and when an upper cover opening detection signal is inputted into the control unit, it sends a movement signal to the process cartridge moving means. The process cartridge moving means controls the process cartridge moving drive means in order to move the process cartridge 15 from the first to the second position. When a positional signal that the process cartridge 15 has moved to the second position, is obtained, the control unit stops the movement of the process cartridge moving drive system.

Figure 28:
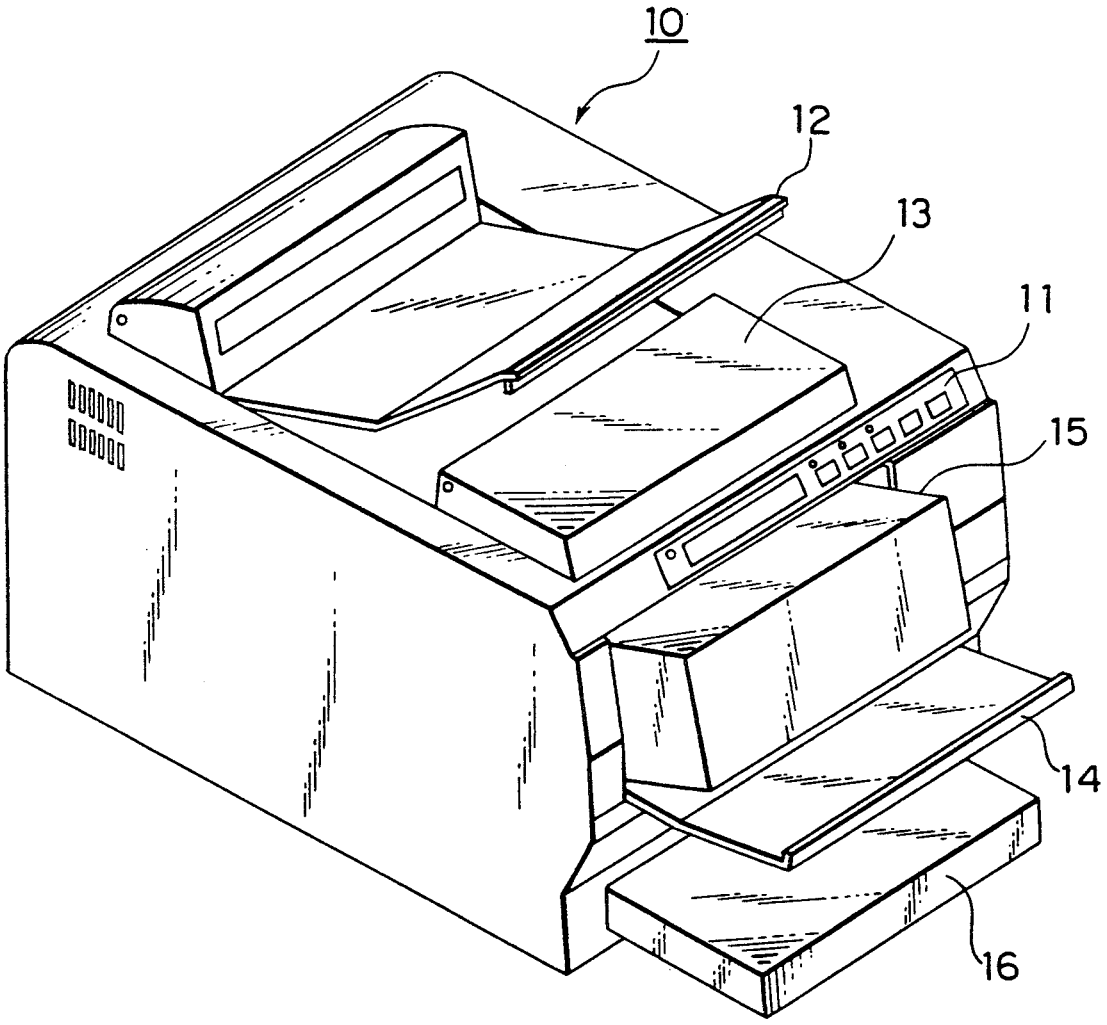
Figure 29:
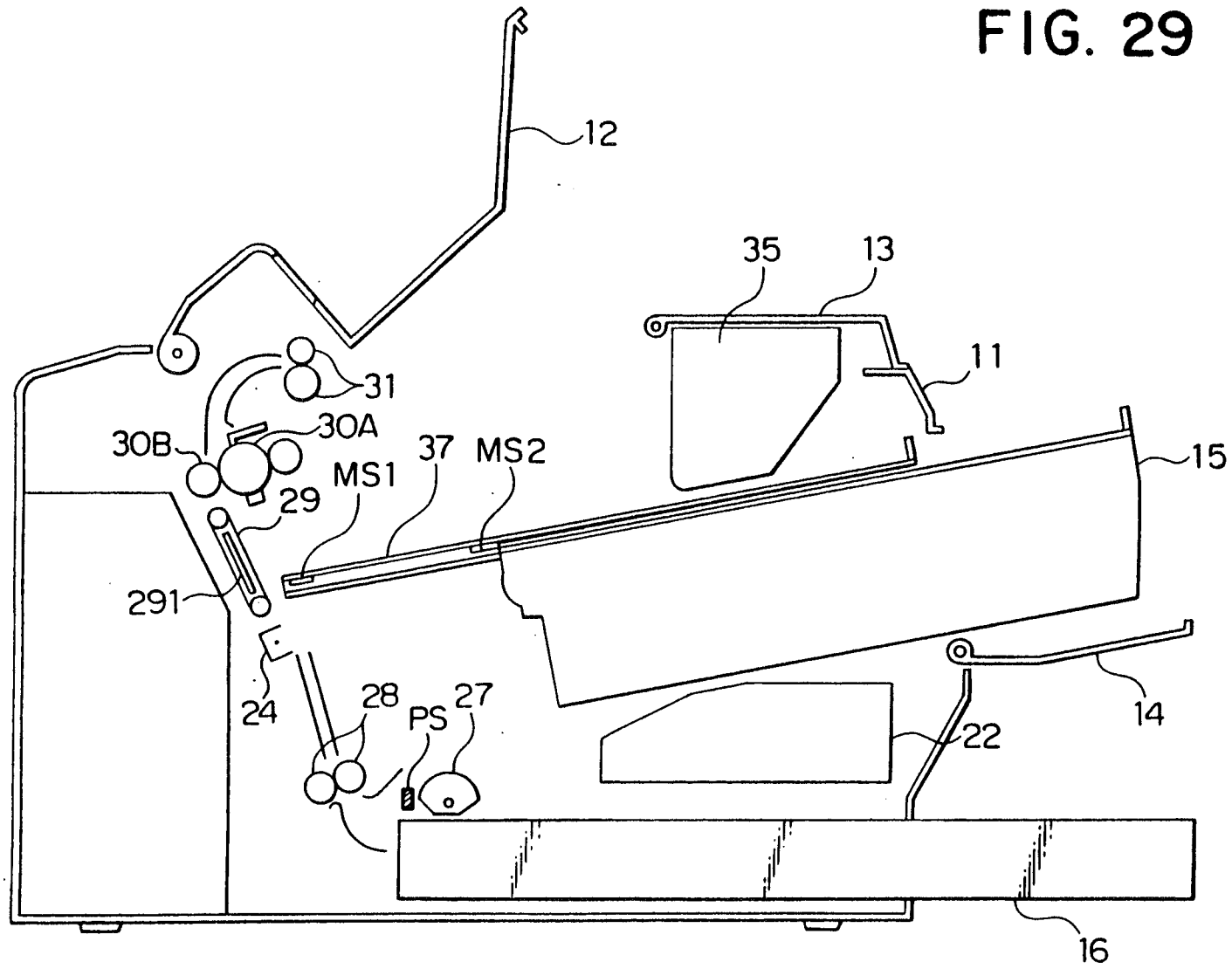

In other words, when the take-out button on the operation panel 11 is pressed in the case of a jam or replacement of the process cartridge 11, the upper cover 12 is opened and withdrawn to the second position as illustrated in FIGS. 28 and 29 so that the jammed sheet P can be removed from the apparatus body 10, and the process cartridge 15 can be taken out by pulling it slightly. Consequently, the process cartridge 15 can be easily replaced. In the case where the take-out button is pressed during an image formation process, the signal is canceled in the control section, so that neither the upper cover 12 is opened nor the process cartridge is moved.

In this embodiment, the present invention is applied to the image forming method in which a color toner image is formed on a photoreceptor belt 17, and the color toner image is transferred onto a transfer sheet by one transfer operation. However, the present invention may be applied to the image forming method in which a toner image is superimposed on a transfer sheet wound around a transfer drum. Further, the present invention can be applied to a conventional monochrome printer in which a monochrome process is utilized. In the aforementioned embodiment, a non-contact developing method is used. However, the present invention is not limited to the specific embodiment, and the present invention can be also applied to a contact developing method. The drive system of the present invention is not limited to the specific embodiment. In this embodiment, a protruded member, guide member, rack and pinion are used to move the process cartridge. However, the present invention is not limited to the specific embodiments.

Figure 30:
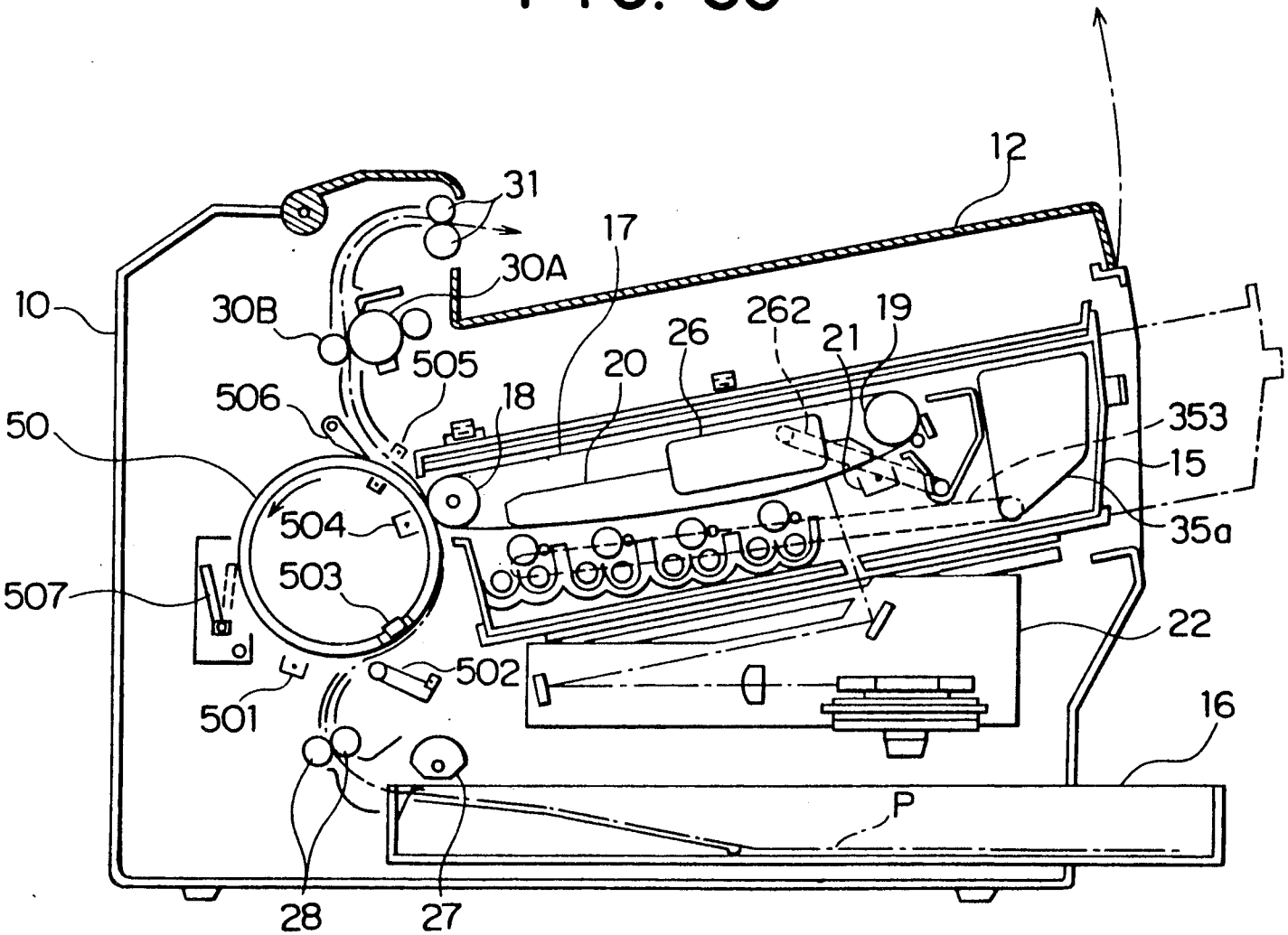

FIG. 30 shows a transfer drum type of image forming apparatus which is the second embodiment of the present invention. The structure of the process cartridge 15 is approximately the same as that of the embodiment explained before. In this embodiment, a toner hopper 35*a* is integrally provided in the process cartridge. In the transfer drum type of image forming apparatus, a transfer drum 50 is contacted with the transfer portion of the photoreceptor belt 17, and the transfer drum 50 is rotated counterclockwise synchronously with the photoreceptor belt 17. A transfer sheet is wound around the circumferential surface of the transfer drum 50, and a toner image of each color formed on the photoreceptor belt 17 is transferred onto the transfer sheet wound around the transfer drum so that the toner image can be superimposed, and then the transfer sheet is separated from the transfer drum 50 and the toner image is fixed. After that, the transfer sheet is discharged onto the upper portion of the apparatus body.

A charging unit 501 which electrostatically attracts the transfer sheet and a winding member 502 which mechanically wounds the transfer sheet around the transfer drum 50 are provided in the peripheral portion of the transfer drum 50. A roller is mounted on the tip of the winding member 502, and the roller is contacted with the transfer drum 50 only when the leading edge of the transfer sheet is wound around the transfer drum 50. A gripper 503 is provided on the circumferential surface of the transfer drum 50 in order to hold the leading edge of the transfer sheet which has been conveyed synchronously. The transfer unit 504 electrostatically transfers the toner image formed on the photoreceptor belt 17 onto the transfer sheet. A discharging electrode 505 and a separating claw 506 separate the transfer sheet from the transfer drum 50 after the toner image has been transferred onto the transfer sheet. A cleaner 507 which can be contacted with or separated from the transfer drum 50, removes the residual toner on the transfer drum 50.

A yellow toner image is transferred onto a transfer sheet in such a manner that: the transfer sheet which has been fed from the cassette 16 is synchronously conveyed to the transfer drum 50 which has been charged by the charging unit 501; the transfer sheet is wound around the transfer drum 50 by the winding member 502; the leading edge of the transfer sheet is held by the gripper 503; the transfer sheet is rotated together with the transfer section of the photoreceptor belt 17; and the yellow toner image formed on the photoreceptor belt 17 is transferred onto the transfer sheet by the transfer unit 504. After the first transfer operation has been completed, the transfer drum 50 is continuously rotated and cleaned by the cleaner 507, and then the next toner image is transferred. A magenta toner image is transferred in the second rotation of the transfer drum 50, a cyan toner image is transferred in the third rotation, and a black toner image is transferred in the fourth rotation in such a manner that each toner image is superimposed. After 4 toner images has been transferred, the transfer sheet is discharged by the discharging electrode 505, and the leading edge of the transfer sheet is released by the separating claw 506, and then the transfer sheet is conveyed to the fixing roller 30.

In the image forming apparatus of this embodiment, the transfer drum 50 is provided on the apparatus body 10 side, so that it is not integrated in the process cartridge 15. Accordingly, the process cartridge 15 is moved in the same manner as the aforementioned embodiment.

In this embodiment, the upper cover 12 covers the upper portion of the apparatus body 10 and can be opened and closed. The upper surface of the upper cover 12 serves for a paper discharging tray. The opening and closing mechanism and operations are the same as those of the aforementioned embodiment.

Figure 31:
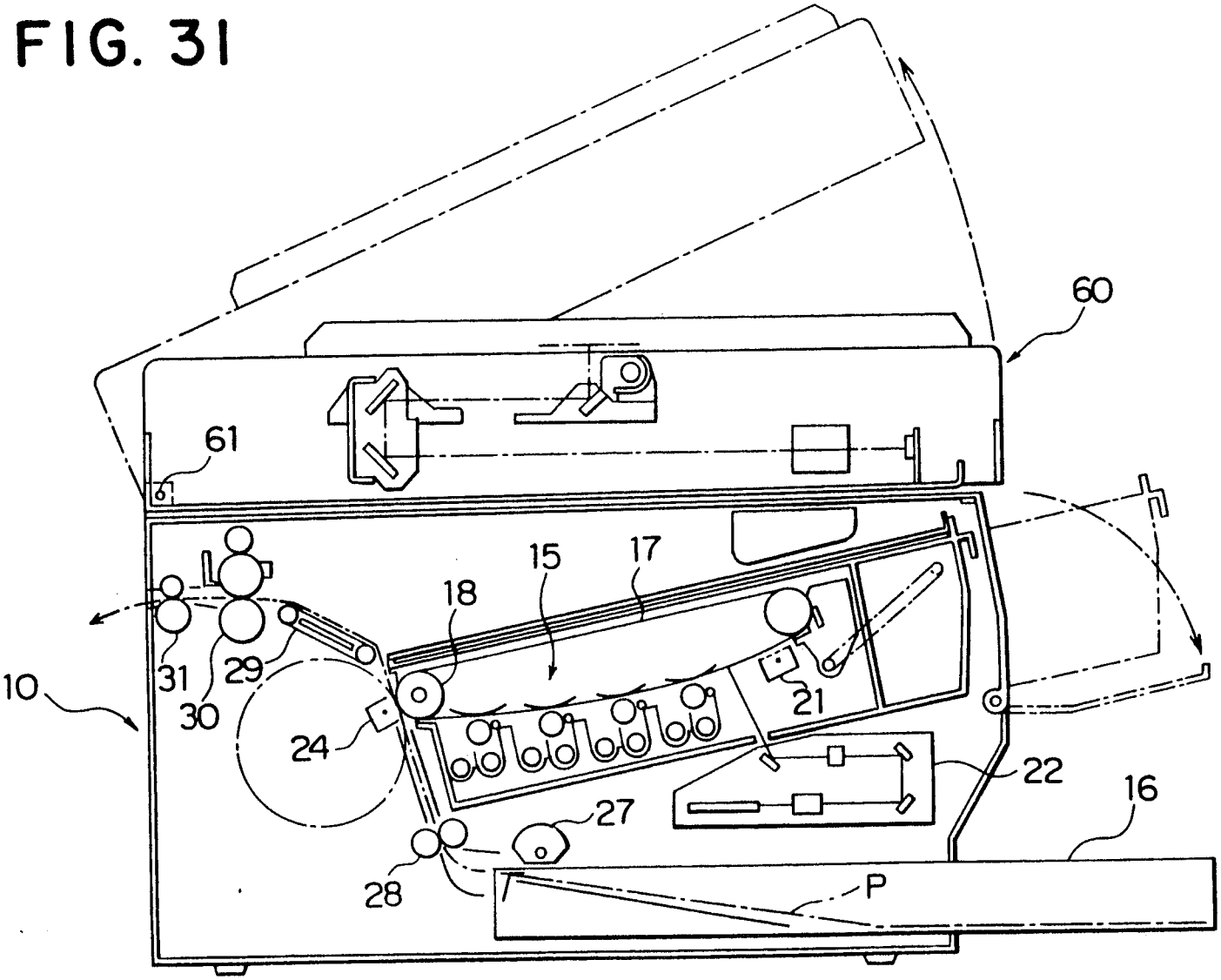

FIG. 31 is a view showing the composition of a color image recording apparatus to which an image reading unit (a scanner) 60 is provided.

The bottom portion of the image reading unit 60 covers the upper opening of the image forming apparatus body 10. One end of the image reading unit 60 is pivotally supported by an oscillating shaft 61 of the image forming apparatus body 10 so that the image reading unit 60 can be rotated around the oscillating shaft 61.

When the aforementioned image reading unit 60 is rotated upward, the upper opening of the image forming apparatus 10 can be opened, and the process cartridge 15 is moved from the aforementioned first position (the position where image formation is conducted) to the second position (where a jam treatment can be conducted and the process cartridge 15 can be pulled outside).

A transfer unit 24 in the drawing may be replaced with the aforementioned transfer drum 50. The process cartridge 15 may be installed horizontally. The aforementioned photoreceptor belt, which is used for an image carrier of the process cartridge, may be replaced with a photoreceptor drum.

Figure 27:
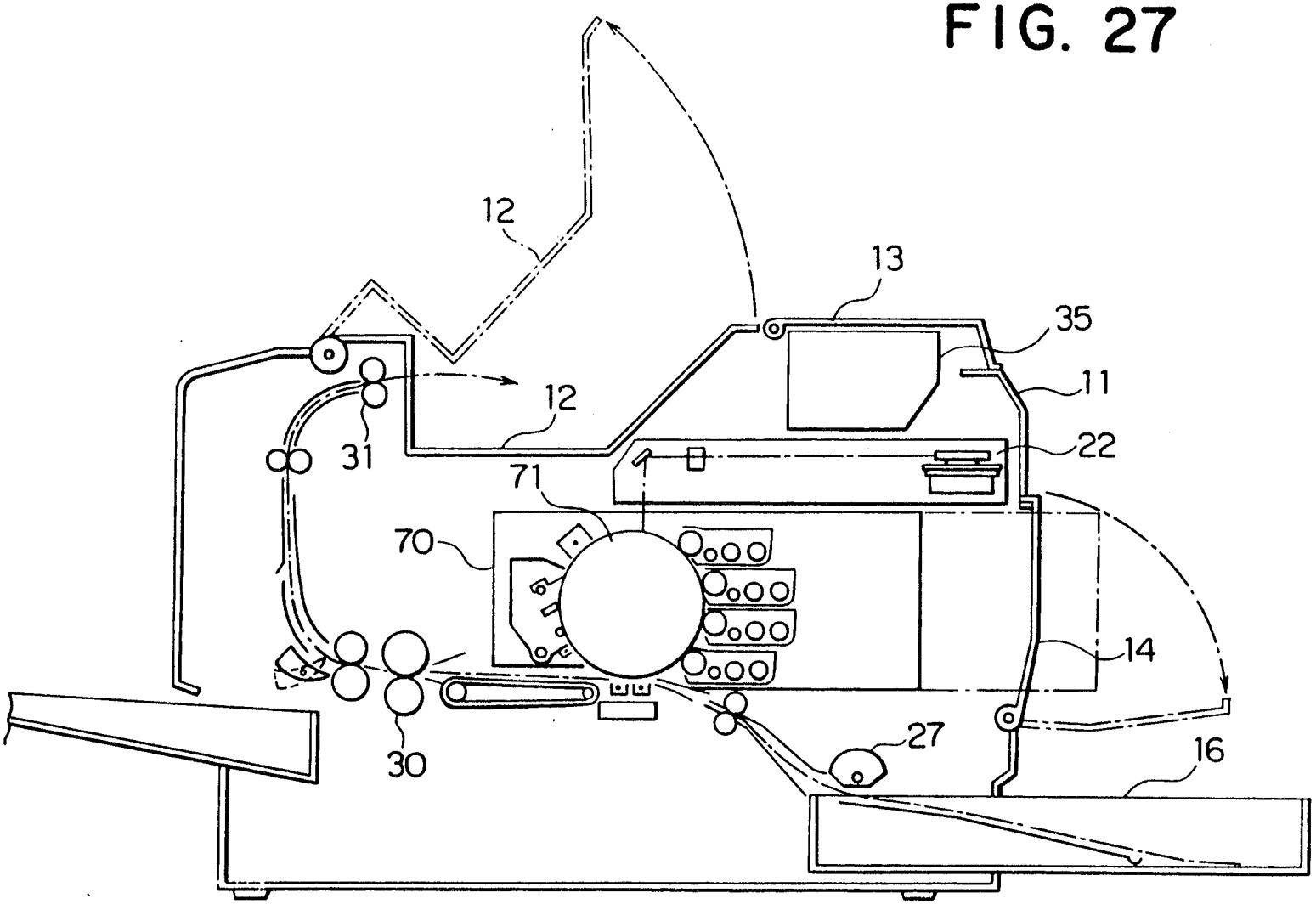

FIG. 27 is a view showing the composition of an image forming apparatus in which a process cartridge having a photoreceptor drum 71 for an image carrier can be moved. In this embodiment, when the upper cover 12 is opened, the process cartridge 70 is moved from the first to the second position, so that it can be taken out of the apparatus and a jammed paper can be easily removed. Maintenance work such as replacement of a fixing cleaner and an ozone filter, cleaning and inspection of the inside of the apparatus, and cleaning of the transfer electrode, can be easily conducted.

The paper feed cassette 16 is detachably provided below the aforementioned image forming apparatus body 10. The paper feed cassette 16 can be also moved from the first position in which transfer sheets can be fed, to the second position in which the paper feed cassette can be taken out or transfer sheets can be supplied.

As shown in FIG. 21, rack gear RG2 is provided on one side of the housing of the paper feed cassette 16. The rotation of the aforementioned gear G28 is transmitted to a bevel gear not shown in the drawing through intermediate gear G44 and intermediate gear G45 in which a spring clutch is installed, so that pinion gear PG2 is rotated and further rack gear RG2 is linearly moved. The drive force transmitting mechanism of the aforementioned gear train is approximately the same as that of the process cartridge 15 shown in FIG. 22.

When the upper cover 12 of the apparatus body 10 is opened, the paper feed cassette 16 is linearly moved from the first position in which transfer sheets can be fed, to the second position in such a manner that it is withdrawn in the direction opposite to that of paper feeding. In the second position, transfer papers can be supplied or the paper feed cassette can be taken out to the outside of the apparatus body.

When a toner of either of the toner hoppers 35*a*–35*d* lacks, a toner supply display is lit on the operation panel. The operator checks the display and opens the toner supply cover 13 so that the toner is supplied. When it is detected that the toner supply cover 13 has been opened, the aforementioned upper cover 12 is opened by the opening detection signal, so that the aforementioned jam treatment and maintenance can be easily conducted.

As described above, in the embodiment of the present invention, when a button of the operating section is pressed, the upper cover can be opened, and at the same time, the process cartridge is withdrawn from the image forming position. When the process cartridge is inserted into the apparatus body, it can be set to the most optimum position.

In the image forming apparatus of the present invention, the process cartridge is moved and the upper cover is opened by a simple operation, so that the operator can replace the process cartridge very easily and the labor can be lessened. When a jammed paper is removed, the process cartridge can be withdrawn to the second position by a command signal inputted from the operation panel or by a jam signal, and the operator can check the inside of the apparatus through the opening formed when the upper cover has been opened. Accordingly, a wide work space can be ensured and the workability is greatly improved in the process of jam treatment, cleaning of the transfer unit, and replacement of the fixing cleaner and ozone filter. Further, there is no possibility that the image carrier is damaged when a jammed transfer sheet is removed, and it is not necessary for the operator to touch the surface of the image carrier.

The opening motion of the upper cover generates a signal to be used for various purposes in order to ensure the safety of the apparatus and to prevent a failure of operation. The upper cover which has been opened, can be easily checked by the operator, so that the operator can judge quickly whether the apparatus is in operation or not, and processing can be easily carried out.

In the case where the present invention is applied to a color printer, the operations of process cartridge insertion, paper feed cassette insertion, jam treatment, multicolor toner supply, and upper cover opening and closing, can be conducted from the front side of the apparatus body, so that the operability and maintainabilty can be greatly improved.

What is claimed is:

1. An image forming apparatus comprising:

a cassette detachably coupled to the apparatus, for containing copy sheets;

cassette driving means for moving the cassette in a release direction from a first position suitable for feeding a copy sheet, to a second position;

an upper cover for covering an opening in an upper portion of the apparatus, the upper cover being adapted to selectively take a closed position and an open position;

open position detecting means for generating an open position signal responsive to detecting that the upper cover is in the open position thereof; and control means responsive to the open position signal for controlling the cassette driving means to move the cassette in the release direction from the first position to the second position.

2. The apparatus of claim 1, wherein the release direction is the same as a direction to detach the cassette from the apparatus.

3. The apparatus of claim 1, further comprising:

manual operation means for generating a manual release signal, and wherein the control means is responsive to the manual release signal for controlling the cassette driving means to move the cassette in the release direction from the first position to the second position.

4. The apparatus of claim 1, further comprising:

closed position detecting means for generating a closed position signal responsive to detecting that the upper cover is in the closed position thereof; and means for generating a second position signal responsive to detecting that the cassette is at the second position; and wherein the control means controls the cassette driving means to move the cassette from the second position to the first position responsive to receiving both the closed position signal and the second position signal.

5. An image forming apparatus comprising:

an image carrying body for carrying a latent image on a surface thereof;

developing means for developing the latent image to form a developed image;

cleaning means for cleaning the surface of the image carrying body;

a process cartridge detachably provided in a main body of the apparatus and including therein at least one of the image carrying body, the developing means and the cleaning means;

cartridge driving means for moving the process cartridge in a release direction from a first position suitable for image forming, to a second position;

a cassette detachably coupled to the main body of the apparatus for containing copy sheets;

cassette driving means for moving the cassette from a feed position suitable for feeding copy sheets, in a release direction;

jam detection means for generating a jam signal responsive to detecting jamming of a fed copy sheet in conveying the fed copy sheet through the apparatus; and control means responsive to the jam signal for controlling the cartridge driving means to move the process cartridge in the release direction from the first position thereof to the second position thereof.

6. The apparatus of claim 5, wherein the release direction of the process cartridge is the same as the release direction of the cassette.

7. The apparatus of claim 5, wherein the release direction of the process cartridge is the same as a detaching direction to pull the process cartridge out of the main body.

8. The apparatus of claim 5, further comprising:

means for generating a paper shortage signal responsive to detecting that the cassette is without copy sheets therein; and wherein the control means includes means responsive to the paper shortage signal for controlling the cassette driving means to move the cassette in the release direction from the feed position.

9. The apparatus of claim 5, wherein the release direction of the cassette is the same as a pull out direction of the cassette from the main body.

10. An image forming apparatus comprising:

a main body having an outer case;

an image carrying body for forming a latent image on a surface thereof;

a process cartridge including therein at least the image carrying body;

a cassette detachably coupled to the main body for containing copy sheets;

an upper cover adapted to selectively open an upper portion of the outer case of the main body by taking an open position; and means for generating an open position signal responsive to detection of the upper cover being at the open position thereof, wherein the process cartridge and the cassette are released from their operable positions at which they respectively perform image forming and feeding of the copy sheets.

11. The apparatus of claim 10 further comprising:

means for generating a jam signal responsive to detecting an occurrence of jamming of a copy sheet in a conveyance path through the apparatus; and means for automatically opening the upper cover responsive to the jam signal.

12. The apparatus of claim 10, wherein the upper cover includes tray means for receiving copy sheets after having been discharged from the apparatus.

13. The apparatus of claim 10, wherein the upper cover is operable by a manual operation.

14. The apparatus of claim 10, wherein the image carrying body comprises a photoreceptor belt.

* * * * *